US007168800B2

(12) United States Patent
Katayama

(10) Patent No.: US 7,168,800 B2
(45) Date of Patent: Jan. 30, 2007

(54) INKJET RECORDING APPARATUS AND INK CARTRIDGE

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 286 days.

(21) Appl. No.: 10/889,138

(22) Filed: Jul. 13, 2004

(65) Prior Publication Data

US 2005/0012795 A1 Jan. 20, 2005

(30) Foreign Application Priority Data

Jul. 17, 2003 (JP) ..... 2003-198441
Sep. 3, 2003 (JP) ..... 2003-310819

(51) Int. Cl.
*B41J 2/175* (2006.01)

(52) U.S. Cl. ..... 347/86; 347/85; 347/7

(58) Field of Classification Search ..... 347/7, 347/19, 85, 86; 141/2, 18
See application file for complete search history.

(56) References Cited

U.S. PATENT DOCUMENTS 4,419,678 A 12/1983 Kasugayama et al.
4,782,754 A 11/1988 Pohlig
6,022,102 A * 2/2000 Ikkatai et al. ..... 347/85
6,520,630 B1 * 2/2003 Oda et al. ..... 347/85
6,702,427 B1 3/2004 Shimizu et al.
6,702,433 B1 3/2004 Kono
6,726,313 B1 * 4/2004 Oda et al. ..... 347/85
6,824,258 B1 * 11/2004 Yamamoto et al. ..... 347/86
2002/0118236 A1 8/2002 Uetsuki

FOREIGN PATENT DOCUMENTS

| | | |
|---|---|---|
| EP | 0 236 937 A1 | 9/1987 |
| EP | 0 509 747 A1 | 10/1992 |
| EP | 1 164 024 A2 | 12/2001 |
| EP | 1 232 869 A1 | 8/2002 |
| EP | 1 232 870 A1 | 8/2002 |
| EP | 1 232 871 A1 | 8/2002 |
| JP | A 62-227650 | 10/1987 |
| JP | U 64-32137 | 2/1989 |
| JP | A 2002-234180 | 8/2002 |
| JP | A 2002-307711 | 10/2002 |

* cited by examiner

*Primary Examiner*—Anh T. N. Vo
(74) *Attorney, Agent, or Firm*—Oliff & Berridge, PLC

(57) ABSTRACT

An ink cartridge for reserving an ink in an inner space defined therein, including: (a) an ink supplying portion provided to face a lower portion of the inner space so as to allow supply of the ink from the inner space therethrough; (b) an air introducing portion provided to face the lower portion of the inner space so as to allow introduction of an air into the inner space therethrough; (c) at least one electrode receiver for receiving first and second electrodes, such that the first and second electrodes face the inner space; and (d) a bubble-path-formation restrainer restraining an electrical path allowing a continuity between the first and second electrodes, from being formed of a bubble which is generated as a result of the introduction of the air into the inner space. Also disclosed is an inkjet recording apparatus including the above-described ink cartridge and a detector which detects an electrical characteristic between the first and second electrodes.

42 Claims, 16 Drawing Sheets

INKJET RECORDING APPARATUS AND INK CARTRIDGE

This application is based on Japanese Patent Applications No. 2003-198441 filed in Jul. 17, 2003 and No. 2003-310819 filed in Sep. 3, 2003, the content of which is incorporated hereinto by reference.

BACKGROUND OF THE INVENTION

1. Field of the Invention

The present invention relates in general to an inkjet recording apparatus and an ink cartridge, and more particularly to an inkjet recording apparatus and an ink cartridge which makes it possible to accurately detect that an amount of remaining ink is reduced to a predetermined amount.

2. Discussion of Related Art

There is known an inkjet recording apparatus, as disclosed in U.S. Pat. No. 6,702,433 (corresponding to JP-A-2002-234180), in which an amount of remaining ink is detected by a pair of electrodes. One of the pair of electrodes is provided by an ink drawing hollow needle for drawing the ink from an ink reservoir, while the other of the pair of electrodes is provided by an air introducing hollow needle for introducing an atmospheric air into the ink reservoir. The pair of electrodes provided by the respective hollow needles are disposed in a bottom portion of the ink reservoir, in substantially parallel with each other. The air is introduced into the ink reservoir through the air introducing hollow needle when the ink is drawn from the ink reservoir through the ink drawing hollow needle. An amount of the air thus introduced into the ink reservoir corresponds to an amount of a reduction in the pressure in the ink reservoir which is caused by the discharge of the ink from the ink reservoir.

In this instance, the air introduced into the ink reservoir through the air introducing hollow needle takes the form of bubbles, since the air introducing hollow needle is immersed in the ink mass, as shown in FIG. 7A. When a certain amount of the ink has been drawn from the ink reservoir through the ink drawing hollow needle 351, namely, when a top surface of the ink mass has become lower than an upper end of a tubular partition wall 364 which surrounds the air introducing hollow needle 352, an electrical continuity between the two hollow needles 351, 352 via the ink is lost, whereby a so-called "cartridge empty" is detected. However, after the detection of the cartridge empty, the two hollow needles 351, 352 are likely to be electrically connected to each other via the air bubbles overflowing the tubular partition wall 364 and deposited in the vicinity of the upper end of the tubular partition wall 364, as shown in FIG. 7B. This electrical connection between the needles 351, 352 via the overflowing air bubbles undesirably provides an erroneous detection or determination that the ink remains in the ink reservoir. Such an erroneous determination causes the air to be delivered to a print head of the inkjet recording apparatus, so that the print head having thus sucked up the air is not likely to satisfactorily perform a printing operation.

There is also known an inkjet recording apparatus in which an ink cartridge and a buffer tank provided under the ink cartridge are held in communication with each other via an ink supply passage and an air introduction passage. In this arrangement, a back pressure acting on a print head of the apparatus is held constant irrespective of an amount of the ink remaining in the ink cartridge, while an amount of the ink remaining in the buffer tank is detected.

As an example of such an inkjet recording apparatus, U.S. Pat. No. 6,702,427 (corresponding to JP-A-2002-307711) discloses an apparatus in which the ink supply passage and the air introduction passage are respectively provided by an ink drawing hollow needle and an air introducing hollow needle which are both formed of a conductive material. In this inkjet recording apparatus, the air introducing hollow needle 552 has a lower end which is given a height larger than a lower end of the ink drawing hollow needle 551, as shown in FIG. 12. When a top surface of mass of the ink left in the buffer tank 503 becomes lower than the lower end of the air introducing hollow needle 552 as a result of consumption of the ink, the air is introduced into the ink cartridge through the air introducing hollow needle 552 while the ink is supplied to the buffer tank 503 from the ink cartridge 502. Thus, the height of the top surface of the ink mass in the buffer tank 503 is held substantially constant, whereby the back pressure acting on the print head is held constant irrespective of the amount of the ink remaining in the ink cartridge 502. Meanwhile, the amount of the ink remaining in the buffer tank 503 can be detected by detecting change in an electrical resistance between the two hollow needles 551, 552.

In this inkjet recording apparatus, it is determined that the buffer tank 503 is empty or near empty, provided that a pass establishing the electrical continuity between the two hollow needles 551, 552 within the ink cartridge 502 is lost and that a pass establishing the electrical continuity within the buffer tank 503 is also lost. However, where printing operations consuming a large amount of ink are consecutively carried out while the buffer tank 503 is almost empty, a large number of bubbles W are formed by introduction of the air into the ink cartridge 502 through the hollow needle 552. The formed bubbles W are likely to stay in the vicinity of the hollow needles 551, 552, whereby the hollow needles 551, 552 are likely to be electrically connected to each other via the remaining bubbles W.

As shown in FIG. 12, the top surface of the ink mass in the ink cartridge 502 has been lowered to be lower than a partition wall 564 surrounding the air introducing hollow needle 552, and the top surface of the ink mass in the buffer tank 503 has been also lowered to be lower than the lower end of the air introducing hollow needle 552. In this instance, the ink no longer forms an electrical path establishing the continuity between the hollow needles 551, 552. However, the hollow needles 551, 552 can be electrically connected to each other via the bubbles W which have been formed as a result of the introduction of the air into the ink cartridge 502 and which overflows the partition wall 564. This state provides an erroneous determination that the ink still remains in the ink reservoir, although the buffer tank 503 is actually almost empty. That is, in the conventional apparatus, an accurate detection of the ink remaining amount has been difficult.

SUMMARY OF THE INVENTION

The present invention was made in view of the background prior art discussed above. It is therefore a first object of the invention to provide an ink cartridge which makes it possible to accurately detect that an amount of remaining ink is reduced to a predetermined amount. It is a second object of the invention to provide an inkjet recording apparatus in which it is possible to accurately detect that an amount of remaining ink is reduced to a predetermined amount. The first object may be achieved according to any one of first through third aspects of the invention which are described below. The second object may be achieved according to fourth or fifth aspect of the invention which are described below.

The first aspect of the invention provides an ink cartridge for reserving an ink in an inner space defined therein, comprising: (a) an ink supplying portion provided to face a lower portion of the inner space so as to allow supply of the ink from the inner space therethrough; (b) an air introducing portion provided to face the lower portion of the inner space so as to allow introduction of an air into the inner space therethrough; (c) at least one electrode receiver for receiving a first electrode and a second electrode, such that the first electrode and the second electrode face the inner space; and (d) a bubble-path-formation restrainer restraining an electrical path allowing a continuity between the first electrode and the second electrode, from being formed of a bubble which is generated as a result of the introduction of the air into the inner space.

In the present ink cartridge which includes the bubble-path-formation restrainer, it is possible to prevent the first and second electrodes are electrically connected to each other via the bubble which is generated as a result of the introduction of the air into the ink reserved in the inner space of the ink cartridge, thereby making it possible to accurately detect that an amount of remaining ink is reduced to a predetermined amount. The present ink cartridge can be advantageously used not only in an inkjet recording apparatus in which the ink remaining amount is detected by checking a top surface of mass of the ink left in the ink cartridge but also in an inkjet recording apparatus in which the ink remaining amount is detected by checking a top surface of mass of the ink left in a buffer tank which is held in communication with the ink cartridge through tubular or hollow members (e.g. hollow needles) which allow flows of the ink and the air therebetween and also serve as the electrodes. It is noted that the present ink cartridge may be either an ink cartridge charged with the ink, or an ink cartridge not yet charged with the ink. It is also noted that the term "restraining the electrical path allowing the continuity between the first and second electrodes, from being formed of the bubble" is interpreted to mean not only reduction of possibility of the formation of the electrical path by the bubble, but also substantially zeroing such a possibility. In this sense, the term "bubble-path-formation restrainer" may be referred also to as "bubble-path-formation preventer".

According to the second aspect of the invention, in the ink cartridge in the first aspect of the invention, the ink cartridge further includes a partition which projects upwardly from a bottom of the ink cartridge so as to have a predetermined height, and which divides a lower portion of the inner space into a first region and a second region, wherein the at least one electrode receiver receives the first electrode and the second electrode, such that the first electrode faces the first region while the second electrode faces the second region, and wherein the bubble-path-formation restrainer includes a bubble breaker which breaks the bubble, and/or bubble retainer which retains the bubble on one of opposite sides of the partition so as to restrain the bubble from being moved from the one of the opposite sides to the other of the opposite sides.

In the ink cartridge of the second aspect of the invention, the above-described at least one electrode receiver is provided to receive the first and second electrodes such that the first and second electrodes can be brought into contact with the ink reserved in the inner space of the ink cartridge. The first and second electrodes face the respective first and second regions of the lower portion of the inner space which are separated from each other by the partition projecting upwardly from the bottom of the ink cartridge and having the predetermined height. In this arrangement, the electrical path is formed of the ink when the top surface of the ink mass in the inner space is higher than the upper end of the partition, while being interrupted by the partition when the top surface of the ink mass is lower than the upper end of the partition. The bubble generated in the inner space of the ink cartridge is broken by the bubble breaker, or is retained by the bubble retainer so as not to be moved from one of the opposite sides of the partition to the other side of the partition, whereby the electrical path is restrained or prevented from being formed of the bubble. Therefore, when the top surface of the ink mass becomes lower than the upper end of the partition as a result of consume of the ink, namely, when the electrical path allowing the continuity between the electrodes between the electrodes should be interrupted, the electrical path can be reliably retrained or prevented from being formed of the bubble. Thus, it is possible to accurately detect that the ink cartridge is in its empty state or near-empty state, namely, detect that an amount of the ink remaining in the ink cartridge has been reduced to a predetermined amount, where the height of the partition is adapted to correspond to this predetermined amount.

According to the third aspect of the invention, in the ink cartridge in the first or second aspect of the invention, the bubble-path-formation restrainer includes a bubble-movement restrainer wall which is disposed between the first electrode and the second electrode, and which projects upwardly from a bottom of the ink cartridge, the bubble-movement restrainer wall restraining movement of the bubble between opposite sides thereof while allowing movement of the ink between opposite sides thereof.

The ink cartridge of the third aspect of the invention can be advantageously used in an inkjet recording apparatus in which the ink remaining amount is detected by checking a top surface of mass of the ink left in a buffer tank which is held in communication with the ink cartridge through hollow members (e.g. hollow needles) which allow flows of the ink and the air therebetween and also serve as the electrodes. In this ink cartridge of the third aspect of the invention in which the bubble is restrained or prevented from being moved between the opposite sides of the bubble-movement restrainer wall, the electrical path allowing the continuity between the electrodes can be reliably restrained or prevented from being formed of the bubble, when the ink in the ink cartridge has been consumed, namely, when the electrical path should be interpreted. Thus, it is possible to accurately detect that the ink cartridge or buffer tank is in its empty state or near-empty state, namely, detect that an amount of the ink remaining in the ink cartridge or buffer tank, without suffering from influence of the bubble upon an electric characteristics between the first and second electrodes. Further, in this ink cartridge of the third aspect, the supply of the ink from the ink cartridge can be continued even after the top surface of the ink mass in the inner space of the ink cartridge has become lower the bubble-movement restrainer wall, since the bubble-movement restrainer wall allows flow or movement of the ink between its opposite sides. It is noted that the above-described term "restraining movement of the bubble between opposite sides of the bubble-movement restrainer wall" is interpreted to mean not only reduction of possibility of the movement of the bubble between the opposite sides of the bubble-movement restrainer wall, but also substantially zeroing such a possibility. In this sense, the term "bubble-movement restrainer wall" may be referred also to as "bubble-movement inhibitor wall".

The fourth aspect of the invention provides an inkjet recording apparatus comprising: (i) the ink cartridge defined in the above-described second aspect of the invention; (ii) a recording portion which receives the ink supplied from the inner space of the ink cartridge through the ink supplying portion, so as to record an image on a recording medium; and (iii) a detector which detects an electrical characteristic between the first electrode and the second electrode.

The fifth aspect of the invention provides an inkjet recording apparatus comprising: (i) the ink cartridge defined in the above-described third aspect of the invention; (ii) a recording portion which records an image on a recording medium with the ink; (iii) a buffer tank which supplies the ink supplied from the inner space of the ink cartridge through the ink supplying portion, to the recording portion, the buffer tank defining an inner space which is held in communication with an atmosphere; (iv) a first hollow member which extends from a lower portion of the inner space of the buffer tank to the lower portion of the inner space of the ink cartridge so as to supply the ink to the buffer tank from the ink cartridge, the first hollow member providing the first electrode; (v) a second hollow member which extends from an upper portion of the inner space of the buffer tank to the lower portion of the inner space of the ink cartridge so as to introduce the air into the ink cartridge from the buffer tank, the second hollow member providing the second electrode; (vi) a detector which detects an electrical characteristic between the first electrode and the second electrode; and (vii) a determiner which determines, on the basis of detection by the detector, whether an amount of the ink remaining in the buffer tank is lower than a predetermined amount or not.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
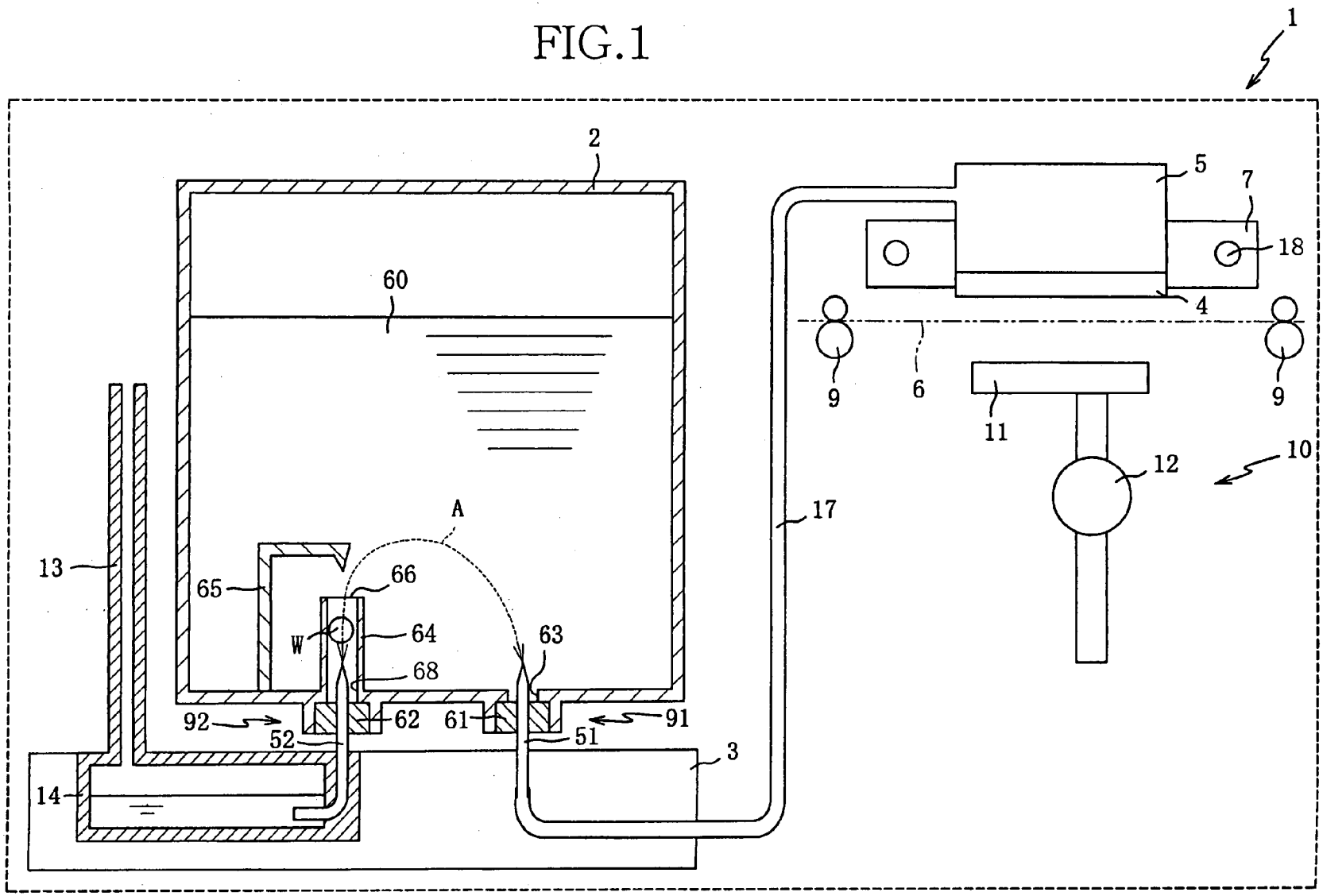
FIG. 1 is a view schematically showing an inkjet recording apparatus equipped with an ink cartridge which is constructed according to a first embodiment of the invention.

Referring first to the schematic view of FIG. 1, there will be described an inkjet recording apparatus in the form of a inkjet printer 1 which is equipped with ink cartridges 2 each constructed according to a first embodiment of this invention. The inkjet printer 1 includes: the ink cartridges 2 filled with respective color inks (e.g., cyan, magenta, yellow and black inks); mount portions 3 on which the ink cartridges 2 are removably mounted; buffer tanks 5 for storing an ink supplied from the ink cartridges 2 through ink supply tubes 17; print heads 4 for ejecting the ink stored in the buffer tanks 5, toward a paper sheet 6; a carriage 7 for carrying the buffer tanks 5 and the print heads 4; a pair of guide shafts 18 for guiding the carriage 7 which is reciprocated along a straight line; a feeding device 9 for feeding the paper sheet 6 in a predetermined direction; and a purging device 10.

Each of the ink cartridges 2 has, in its bottom portion, two electrode receivers 91, 92 for receiving respective electrodes, such that the electrodes are introduced into an inner space of the ink cartridge 2. In the two electrode receivers 91, 92, there are respectively provided two plugs 61, 62 for fluid-tightly sealing the inner space of the ink cartridge 2. The two plugs 61, 62 are in contact with the ink 60 reserved in the ink cartridge 2, through respective openings 63, 68, which are formed through a bottom of the ink cartridge 2 so as to serve as an ink supplying portion and an air introducing portion. A tubular partition wall 64 as a partition is provided to surround the opening 68, and projects upwardly from the bottom of the ink cartridge 2. This tubular partition wall 64 has an upper open end 66 which has a predetermined height as measured from the bottom of the ink cartridge 2.

In each of the mount portions 3, a first hollow member in the form of an ink drawing hollow needle 51 and a second hollow member in the form of an air introducing hollow needle 52 are provided, such that the two hollow needles 51, 52 protrude from the mount portion 3, in substantially parallel with each other. The ink drawing hollow needle 51 serves to draw the ink 60 from the ink cartridge 2, and then supply the ink 60 toward the print head 4 via the ink supply tube 17. The air introducing hollow needle 52 serves to introduce an atmospheric air when a pressure within the ink cartridge 2 is reduced as a result of the supply of the ink 60 from the ink cartridge 2 through the ink drawing hollow needle 51. The air introducing hollow needle 52 is in contact at its lower end with the ink stored in an ink storage chamber 14 which is formed in the mount portion 3. The ink storage chamber 14 is connected at its upper end portion with a communicating passage 13, so as to be held in communication with the atmosphere via the communication passage 13.

With the ink cartridge 2 being mounted on the mount portion 3, the hollow needles 51, 52 are pierced through the respective plugs 61, 62 and brought into contact at their distal end portions with the ink 20 reserved in the ink cartridge 2. Each of the plugs 61, 62 is formed of a butyl rubber or other elastic material permitting the needle 51 or 52 to be pierced therethrough and having a high degree of elasticity or resiliency that assures a sufficient degree of fluid tightness of the ink cartridge 2 even after the needle 51 or 52 is removed therefrom.

When the ink 60 is drawn from the ink cartridge 2 through the ink drawing hollow needle 51 as a result of ejection of the ink 60 by the print head 4, the ink 60 stored in the ink storage chamber 14 is introduced into the ink cartridge 2 through the air introducing hollow needle 52. When the supply of the ink 60 from the ink cartridge 2 toward the print head 4 is continued after the ink 60 stored in the ink storage chamber 14 has been consumed, the pressure within the ink cartridge 2 is reduced. For compensating the reduction in the pressure in the ink cartridge 2, the atmospheric air is introduced into the ink cartridge 2 from the ink storage chamber 14 through the air introducing hollow needle 52. In this instance, an amount of the air introduced into the ink cartridge 2 corresponds to an amount of the reduction in the pressure in the ink cartridge 2. An upper open end portion of the ink drawing hollow needle 51 is positioned to be lower than the upper open end 66 of the tubular partition wall 64, and to be close to the bottom of the ink cartridge 2, so that almost all the ink in the ink cartridge 2 (except the ink accommodated within the tubular partition wall 64) can be eventually delivered toward the print head 4 through the drawing hollow needle 51. The ink accommodated in the tubular partition wall 64 remains without being supplied from the ink cartridge 2, so that the air introducing hollow needle 52 is kept immersed in the ink.

The print head 4 has a plurality of nozzles through which the ink stored in the buffer tank 5 is ejected toward the paper sheet 6. A printing operation is performed on the paper sheet 6, with the ejection of the ink through the nozzles of the print head 4 carried by the carriage 7 which is reciprocated. A purging operation is performed by moving the print head 4 to a purging operation position located outside a printing area (within which the print head 4 is moved for achieving the printing operation), so that ink containing impurities is ejected from the print head 4 toward a waste ink tank (not shown) which is disposed in the purging operation position.

The purging device 10 is arranged to remove poor-quality ink (e.g., ink having an excessively high degree of viscosity) which contains air bubbles and foreign matter and which could close the nozzles of the print head 4. That is, the purging device 10 is provided to restore the print head 4 to its normally operable state. The purging device 10 has a purge cap 11 and a suction pump (PG pump) 12. With the print head 4 being positioned in the purging operation position, the purge cap 11 is brought into contact with an ejection face of the print head 4 so as to cooperate with the ejection face to form a fluid-tight space. The suction pump 12 is then activated to suck the poor-quality ink from the ejection face of the print head 4. It is noted that the purge cap 17 is arranged to be moved toward and away from the ejection face of the print head 4.

Figure 2:
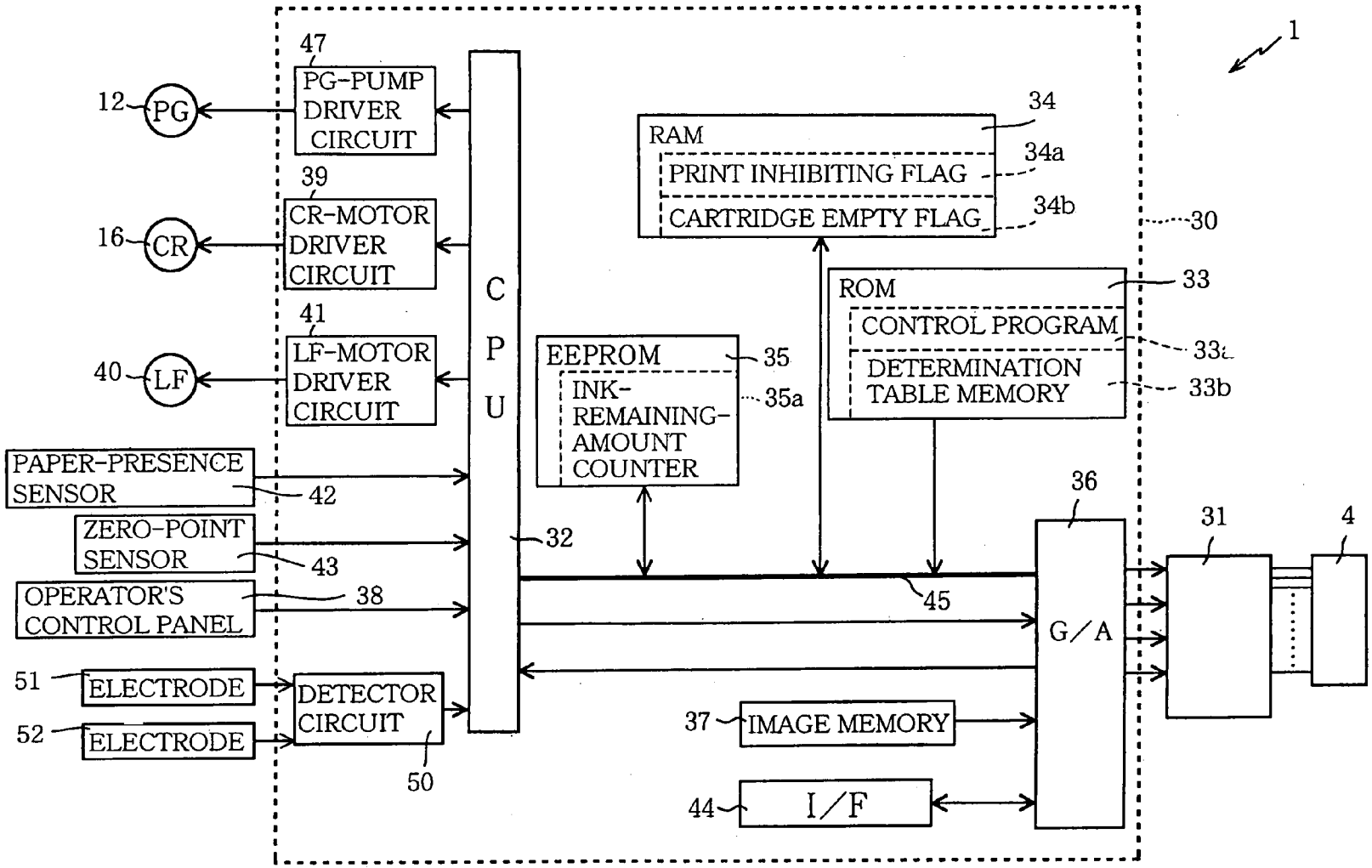
FIG. 2 is a block diagram illustrating an electric circuit arrangement of the inkjet recording apparatus of FIG. 1.

As shown in FIG. 2, the inkjet printer 1 is provided with a control device including a main control board 30 mounted on a main body of the inkjet printer 1, and a carriage board 31 mounted on the carriage 7. The main control board 30 incorporates: a CPU (one-chip microcomputer) 32; a ROM 33 having a control program memory 33*a* storing various control programs executed by the CPU 32 and various fixed data used by the CPU 32; a RAM 34 for temporarily storing various data; an EEPROM 35; an image memory 37; and a G/A (gate array) 36.

The CPU 32 functioning as an arithmetic and logic device is operable to perform various operations according to the control programs stored in the control program memory 33*a* of the ROM 33. The CPU 32 is further operable to generate a printing timing signal and a resetting signal, and apply these signals to the G/A 36. To the CPU 32, there are connected: an operator's control panel 38 through which the user enters desired commands (e.g., printing command) into the main control board 30; a CR-motor driver circuit 39 for operating a carriage drive motor (CR motor) 16 to reciprocate the carriage 7; a LF-motor driver circuit 41 for operating a sheet feeding motor (LF motor) 40 to feed the paper sheet 6; a suction-pump driver circuit 47 for operating the suction pump 12; a detector circuit 50 for detecting a resistance between the ink drawing hollow needle 51 and the air introducing hollow needle 52 which serve as the first and second electrodes, respectively; a paper-presence sensor 42 for detecting a leading edge of the paper sheet 6; and a zero-point sensor 43 for confirming that the carriage 7 is positioned in its zero-point (home) when it is returned to the zero-point. The various elements connected to the CPU 32 are controlled by the CPU 32.

The ROM 33 has a control program memory 33*a* and a determining table memory 33*b* therein. The control program memory 33*a* stores a program for executing a routine for determining an amount of the ink remaining in the ink cartridge 2. The determining table memory 33*b* stores data for determining state of the ink cartridge 2, namely, data indicative of conditions for determining that the ink cartridge 2 is in the near-empty state, on the basis of the resistance between the needles 51, 52 which is detected by the detector 50. The conditions for the determination is stored in a table representative of a relationship between the detected resistance and the ink remaining amount.

The RAM 34 is rewritable volatile memory, and stores a printing inhibit flag 34*a* and a cartridge empty flag 34*b*. The printing inhibit flag 34*a* is used to inhibit a printing operation when an amount counted by an ink-remaining-amount counter 35*a* becomes larger than a predetermined amount. With the printing inhibit flag 34*a* being turned ON, the printing operation is stopped by the CPU 32. The cartridge empty flag 34*b* indicates whether the amount of the ink remaining in the ink cartridge 2 is smaller than a predetermined lower limit, namely, whether the ink cartridge 2 is in the near-empty state. The cartridge empty flag 34*b* is turned ON on the basis of the determination made in the routine program stored in the control program memory 33*a*.

The EEPROM 35 is a rewritable non-volatile memory, and includes the above-indicated ink-remaining-amount counter 35*a*. The counter 35*a* is provided to measure the amount of the ink remaining in the ink cartridge 2. Namely, the counter 35*a* is operated to subtract a sum of an ink amount ejected from the nozzles of the corresponding print head 4 and an ink amount removed from the print head 4 by the purging device 10, from the amount of the ink remaining in the ink cartridge 2 at a point of time at which the cartridge empty flag 34*b* is turned ON. In the present embodiment, there are four ink-remaining-amount counter 35*a* corresponding to the respective four print heads 4. The four counters 35*a* are updated independently of each other. It is noted that each of the counters 35*a* is initialized when the corresponding ink cartridge 2 is replaced by a new one.

The G/A (gate array) 36 is operable according to a printing timing signal received from the CPU 32, and image data stored in the image memory 37, to generate printing data (drive signals) for printing on the paper sheet 6 an image represented by the image data, a clock signal for synchronization with the printing data, a latch signal, a parameter signal for generating a basic printing waveform signal, and an ejection timing signal indicative of a predetermined ink ejection interval. The signals generated by the G/A 36 are fed to the carriage board 31 that incorporates print head drivers.

The G/A 36 is further operable to store, in the image memory 37, the image data received from an external computer or other device through a I/F (centro-interface) 44. The G/A 36 is further operable according to centro-data received from a host computer or other device through the I/F 44, to generate an interruption signal for reception of the centro-data. This interruption signal is fed to the CPU 32. The G/A 36 and the carriage board 31 are connected to each other through a harness cable, for transmission of the various signals therebetween. The CPU 32, ROM 33, RAM 34, EEPROM 35 and G/A 36 are connected to each other through a bus line 45.

The print head drivers incorporated in the carriage board 31 are operable to drive the print heads 4. The print heads 4 are connected to the respective print head drivers through flexible wiring boards on which copper foil wiring patterns are formed on polyimide films of a thickness of 50–150 μm. The print head drivers are controlled by the G/A 36 incorporated in the main control board 30, to apply drive pulses to actuator elements of the print heads 4 such that a pulse train of the drive pulses has a waveform corresponding to a selected printing mode, so that the ink droplets of desired volumes are ejected from the print heads 4.

The detector circuit 50 is provided to apply a voltage between the ink drawing hollow needle 51 and the air introducing hollow needle 52, and to detect a resistance between the two hollow needles 51, 52. The detector circuit 50 transfers data indicative of the detected resistance, to the CPU 32, so that the transferred data are compared with data read out of the above-described table which represents the relationship between the detected resistance and the ink remaining amount and which is stored in the determining table memory 33*b*.

The determination as to the near-empty of the ink cartridge 2 is effected by the CPU 32 in a transition from a state in which a top surface of mass of the ink remaining in the ink cartridge 2 has a larger height than the upper open end 66 of the tubular partition wall 64 so that a continuity between the two hollow needles 51, 52 is established by a path A which is formed of the ink 60, to another state (see FIG. 3) in which the height of the top surface of the ink mass becomes smaller than the upper open end 66 of the tubular partition wall 64 so that the continuity between the two hollow needles 51, 52 is lost. In this instance, the determination is made by comparing an abrupt change in the resistance between the electrodes (i.e., the two hollow needles 51, 52) with the data stored in the determination table memory 33*b*. If it is determined that the ink cartridge 2 is in the near-empty state, the cartridge empty flag 34*b* is turned ON whereby a message indicative of this fact is displayed on, for example, the operator's control panel 38. It is preferable that the printing operation is continued after the cartridge empty flag 34*b* is turned ON, by consuming the ink still remaining in the cartridge 2. In this case, the printing operation is continued until the ink remaining amount (which is measured by the above-indicated ink-remaining-amount counter 35*a*) becomes smaller than a predetermined amount, namely, until the printing inhibit flag 34*a* is turned ON.

Figure 3:
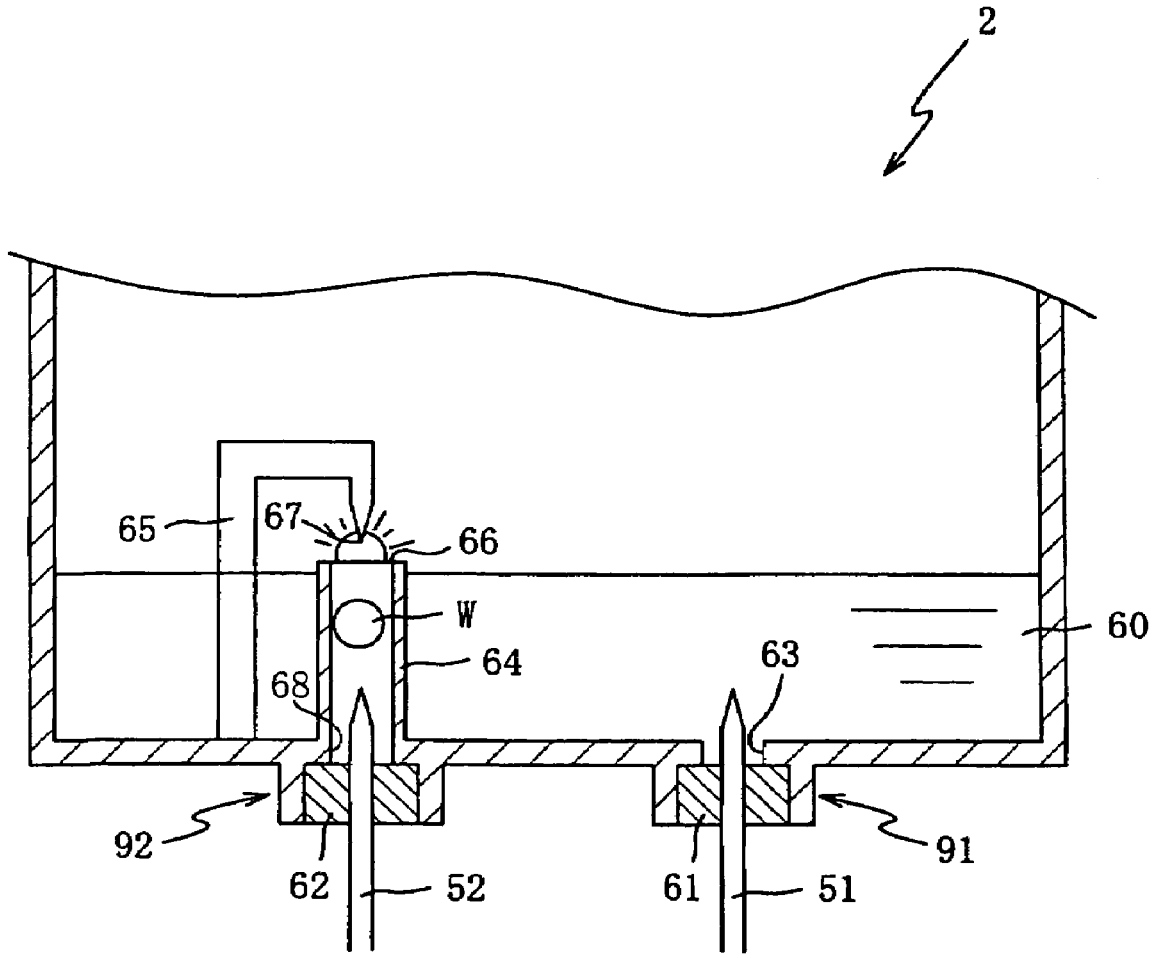
FIG. 3 is a cross sectional view in enlargement showing a bottom portion of the ink cartridge of FIG. 1.

FIG. 3 is a cross sectional view in enlargement showing the bottom portion of the ink cartridge 2, which is in the near-empty state.

As shown in FIG. 3, the ink cartridge 2 has a bubble-path-formation restrainer in the form of a bubble breaker 65 for breaking bubbles which are generated in the tubular partition wall 64 as a result of introduction of the atmospheric air into the ink in the tubular partition wall 64. The bubble breaker 65 having a generally inversed J shape includes: a leg portion which projects upwardly from the bottom of the ink cartridge 2, in parallel with the tubular partition wall 64; and an arm portion which projects horizontally from an upper end portion of the leg portion. The arm portion of the bubble breaker 65 has a distal end portion 67 which is positioned right above substantially a center of the upper open end 66 of the tubular partition wall 64. The distal end portion 67 is shaped to have a sharp point directed toward the upper open end 66 of the tubular partition wall 64, for easily breaking the bubbles.

When the ink is drawn from the ink cartridge 2 through the ink drawing hollow needle 51, the pressure in the inner space of the ink cartridge 2 is reduced. The reduction in the pressure is compensated by introduction of the atmospheric air into the inner space through the air introducing hollow needle 52. In this instance, upon its entrance into the ink reserved in the inner space, the air converts into the bubbles which are then elevated within the tubular partition wall 64. When the top surface of the ink mass outside the tubular partition wall 64 becomes lower than the upper end of the tubular partition wall 64, each bubble appearing on the top surface of the ink mass inside the tubular partition wall 64 is brought into contact with the above-described sharp-pointed distal end portion 67 of the bubble breaker 65. Owing to this arrangement, unlike in a conventional ink cartridge, there is no bubble overflowing the tubular partition wall 64 and moving out of the tubular partition wall 64 toward the top surface of the ink mass outside the tubular partition wall 64, which surface has become lower than the upper end of the tubular partition wall 64. Thus, an electrical connection between the two hollow needles 51, 52 via the bubbles is advantageously avoided, whereby the detection of the near-empty state of the ink cartridge 2 can be accurately made.

Figure 4A:
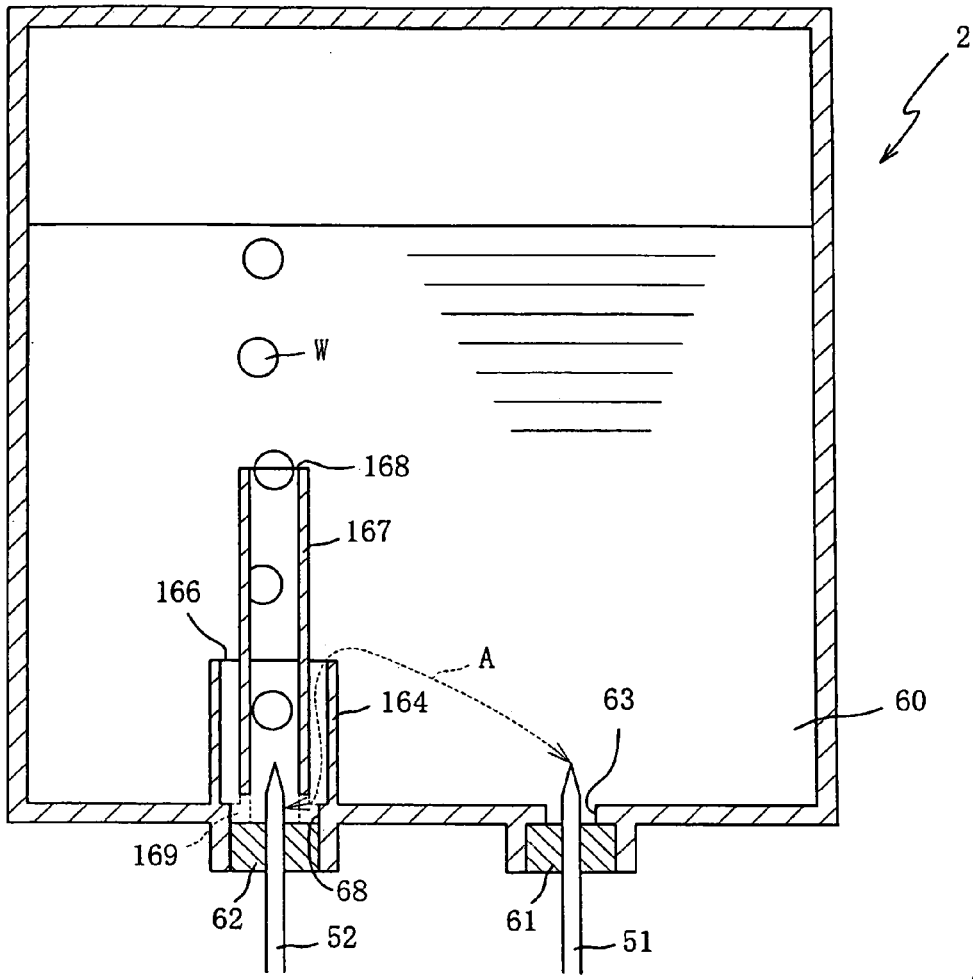
FIGS. 4A and 4B are a set of cross sectional views of an ink cartridge which is constructed according to a second embodiment, wherein 4A shows a state in which a large amount of ink is left in the ink cartridge, while 4B shows a state in which the ink cartridge is nearly empty.
Figure 4B:
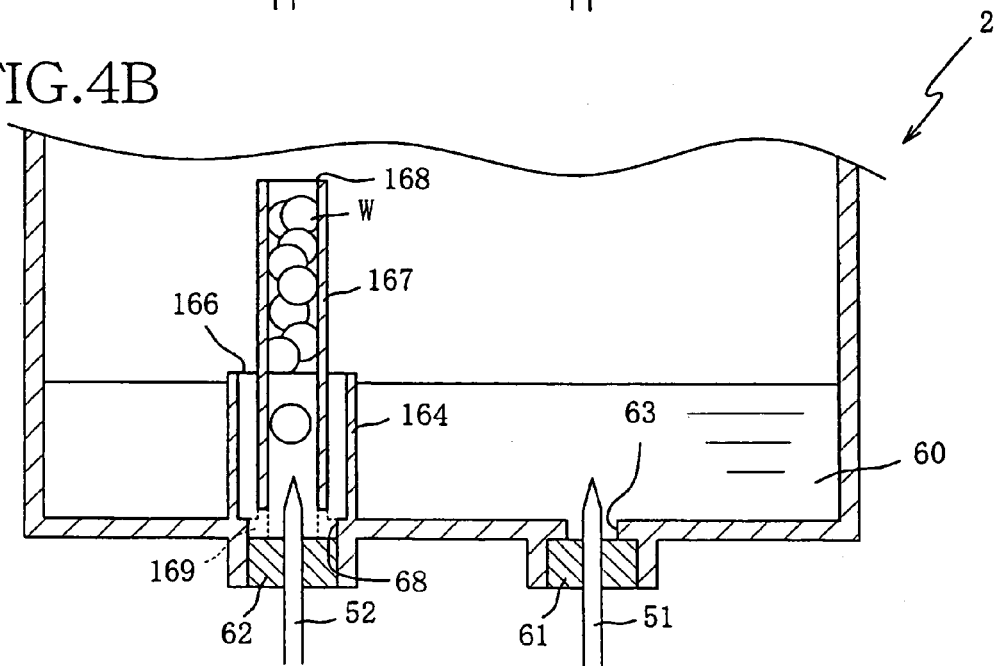

Referring next to FIGS. 4A and 4B, there will be described the ink cartridge 2 which is constructed according to a second embodiment of the invention. FIGS. 4A and 4B are a set of cross sectional views of the ink cartridge 2 as installed on the print head 4, wherein FIG. 4A shows a state in which a large amount of ink 60 is left in the ink cartridge 2, and FIG. 4B shows a state in which the ink cartridge 2 is nearly empty. The same reference numerals as used in the first embodiment will be used to identify the same or similar elements, and redundant description of these elements will not be provided.

Like in the ink cartridge 2 of the first embodiment, the ink drawing hollow needle 51 and the air introducing hollow needle 52 are pierced through the respective plugs 61, 62 and brought into contact at their distal end portions with the ink 60 reserved in the ink cartridge 2, with the ink cartridge 2 being installed on the print head 4. A tubular partition wall 164 as a partition is provided to surround the air introducing hollow needle 52, and projects upwardly from the bottom of the ink cartridge 2. This tubular partition wall 164 has an upper open end 166 which has a predetermined height as measured from the bottom of the ink cartridge 2. A tubular retainer wall 167 as a bubble retainer is provided inside the tubular partition wall 164 so as to be interposed between the air introducing hollow needle 52 and the tubular partition wall 164, and projects upwardly from the bottom of the ink cartridge 2. This tubular retainer wall 167 has an upper open end 168 which has a height larger than the height of the tubular partition wall 164. The tubular retainer wall 167 is positioned relative to the air introducing hollow needle 52, so as to surround a portion of the inner space which portion is located right above the air introducing hollow needle 52, for assuredly retaining the bubbles W therein.

An aperture 169 is formed through a lower end portion of the tubular retainer wall 167 which portion has a height smaller than the upper end of the air introducing hollow needle 52, so that a space inside the tubular retainer wall 167 and a space interposed between the tubular retainer wall 167 and the tubular partition wall 164 are held in communication with each other via the aperture 169. In this arrangement, when the top surface of the ink mass in the ink cartridge 2 is higher than the upper open end 166 of the tubular partition wall 164, the ink drawing hollow needle 51 and the air introducing hollow needle 52 are electrically connected via the electrical path A passing through the upper open end 166 and the aperture 169. When the top surface of the ink mass becomes lower than the upper open end 166, the electrical continuity between the two hollow needles 51, 52 is lost whereby the ink cartridge 2 is determined to be in the near-empty state.

When a large amount of ink 60 is left in the ink cartridge 2, as shown in FIG. 4A, the bubbles W (whose precursor is the air introduced through the air introducing hollow needle 52) are upwardly moved while being guided by an inner circumferential surface of the tubular retainer wall 167. When the ink cartridge 2 is nearly empty, as shown in FIG. 4B, the bubbles W are held inside the tubular retainer wall 167. In this instance, each of the bubbles W is upwardly forced by the succeeding bubble (posteriorly generated bubble) W, and is therefore gradually moved in the upward direction, i.e., toward the upper open end 168 of the tubular retainer wall 167. However, each bubble W is eventually eliminated as the time passes, or is broken by a pressure applied thereto by the inner surface of the tubular retainer wall 167 with which the bubble W tends to be brought in contact. It is noted that the height of the tubular retainer wall 167 is large enough to prevent the bubbles W from overflowing the upper open end 168 even where a large number of bubbles W are generated in case of successive printing operations consuming a large amount of ink.

In the ink cartridge 2 constructed as described above, the bubbles W coming out of the air introducing hollow needle 52 can be held within the tubular retainer wall 167 having the larger height than the tubular partition wall 164, namely, can be held in a space separated by the tubular retainer wall 167 from a space in which the electrical path A is formed, so that the bubbles W are prevented from staying in the vicinity of the upper open end 166 of the tubular partition wall 164 when the top surface of the ink mass outside the tubular partition wall 164 becomes lower than the upper open end 166. Therefore, even where a large number of bubbles W are generated in case of successive printing operations, an electrical connection between the two hollow needles 51, 52 via the bubbles W is advantageously avoided owing to the arrangement in which the bubbles W are reliably held within the tubular retainer wall 167, thereby making it possible to accurately detect the near-empty state of the ink cartridge 2.

Figure 5A:
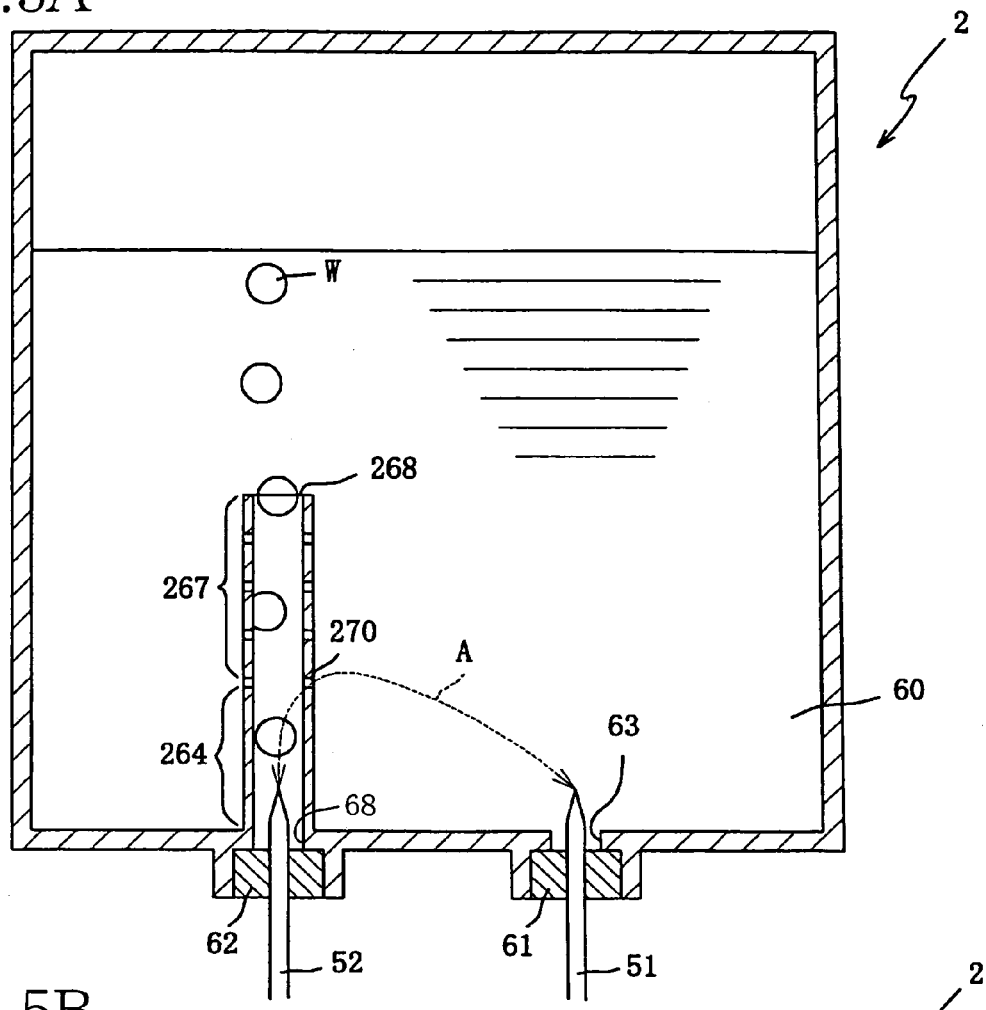
FIGS. 5A and 5B are a set of cross sectional views of an ink cartridge which is constructed according to a third embodiment, wherein 5A shows a state in which a large amount of ink is left in the ink cartridge, while 5B shows a state in which the ink cartridge is nearly empty.
Figure 5B:
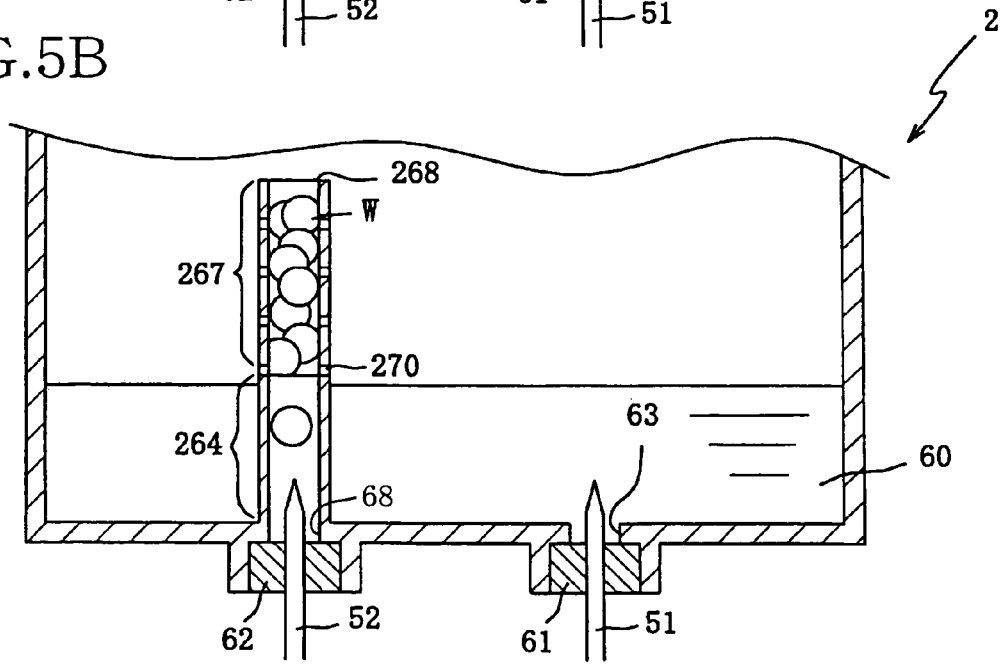

Referring next to FIGS. 5A and 5B, there will be described the ink cartridge 2 which is constructed according to a third embodiment of the invention. FIGS. 5A and 5B are a set of cross sectional views of the ink cartridge 2 as installed on the print head 4, wherein FIG. 5A shows a state in which a large amount of ink 60 is left in the ink cartridge 2, and FIG. 5B shows a state in which the ink cartridge 2 is nearly empty. The same reference numerals as used in the first embodiment will be used to identify the same or similar elements, and redundant description of these elements will not be provided.

Like in the ink cartridge 2 of the first embodiment, the ink drawing hollow needle 51 and the air introducing hollow needle 52 are pierced through the respective plugs 61, 62 with the ink cartridge 2 being installed on the print head 4. A tubular partition wall 264 is provided to surround the air introducing hollow needle 52, and projects upwardly from the bottom of the ink cartridge 2. A tubular retainer wall 267, serving as a bubble retainer for retaining the bubbles W therein and also as a bubble-movement restrainer for restraining movement of the bubbles W therethrough, is disposed on the upper end of the tubular partition wall 264, coaxially with the tubular partition wall 264, so as to project upwardly. The tubular retainer wall 267, having an upper open end 268, may be formed integrally with the tubular partition wall 264, or alternatively may be formed independently of the tubular partition wall 264 and posteriorly connected to the tubular partition wall 264.

The tubular retainer wall 267 having a plurality of communication holes 270 formed therethrough, so that the space inside the tubular retainer wall 267 is held in communication with the space outside the tubular retainer wall 267 through the plurality of communication holes 270. In the present third embodiment, each of the communication holes 270 has a diameter of about 0.6 mm that is small enough to inhibit the bubbles W from flowing out of the space inside the tubular retainer wall 267 therethrough. In this arrangement, when the top surface of the ink mass outside the tubular partition wall 264 is higher than a lowermost one of the communication holes 270, the ink drawing hollow needle 51 and the air introducing hollow needle 52 are electrically connected via each electrical path A passing through the corresponding communication hole 270. When the top surface of the ink mass becomes lower than the lowermost one of the communication holes 270, the electrical continuity between the two hollow needles 51, 52 is lost whereby the ink cartridge 2 is determined to be in the near-empty state.

When a large amount of ink 60 is left in the ink cartridge 2, as shown in FIG. 5A, the bubbles W are upwardly moved while being guided by inner circumferential surfaces of the tubular walls 264, 267. When the ink cartridge 2 is nearly empty, as shown in FIG. 5B, the bubbles W are held within a space which is surrounded by the tubular retainer wall 267 and which is higher than the tubular partition wall 264. In this instance, each of the bubbles W is upwardly forced by the succeeding bubble W, and is therefore gradually moved in the upward direction, i.e., toward the upper open end 268 of the tubular retainer wall 267. However, each bubble W is eventually eliminated as the time passes, or is broken as a result of its contact with edges of the communication holes 270. It is noted that the height of the tubular retainer wall 267 is large enough to prevent the bubbles W from overflowing the upper open end 268 even where a large number of bubbles W are generated in case of successive printing operations.

In the ink cartridge 2 constructed as described above, the bubbles W coming out of the air introducing hollow needle 52 can be held by the tubular retainer wall 267 having the larger height than the tubular partition wall 264, so that the bubbles W are prevented from coming outside the tubular walls 264, 267 when the top surface of the ink mass outside the tubular walls 264, 267 becomes lower than the lowermost communication hole 270. Therefore, even where a large number of bubbles W are generated in case of successive printing operations, an electrical connection between the two hollow needles 51, 52 via the bubbles W is advantageously avoided owing to this arrangement in which the bubbles W are reliably held by the tubular retainer wall 267, thereby making it possible to accurately detect the near-empty state of the ink cartridge 2. Further, owing to the plurality of communication holes 270 formed through the tubular retainer wall 267, a plurality of electrical paths A can be established when a large amount of ink 60 is left in the ink cartridge 2, thereby preventing the ink cartridge 2 from being erroneously determined to be near empty.

Figure 6:
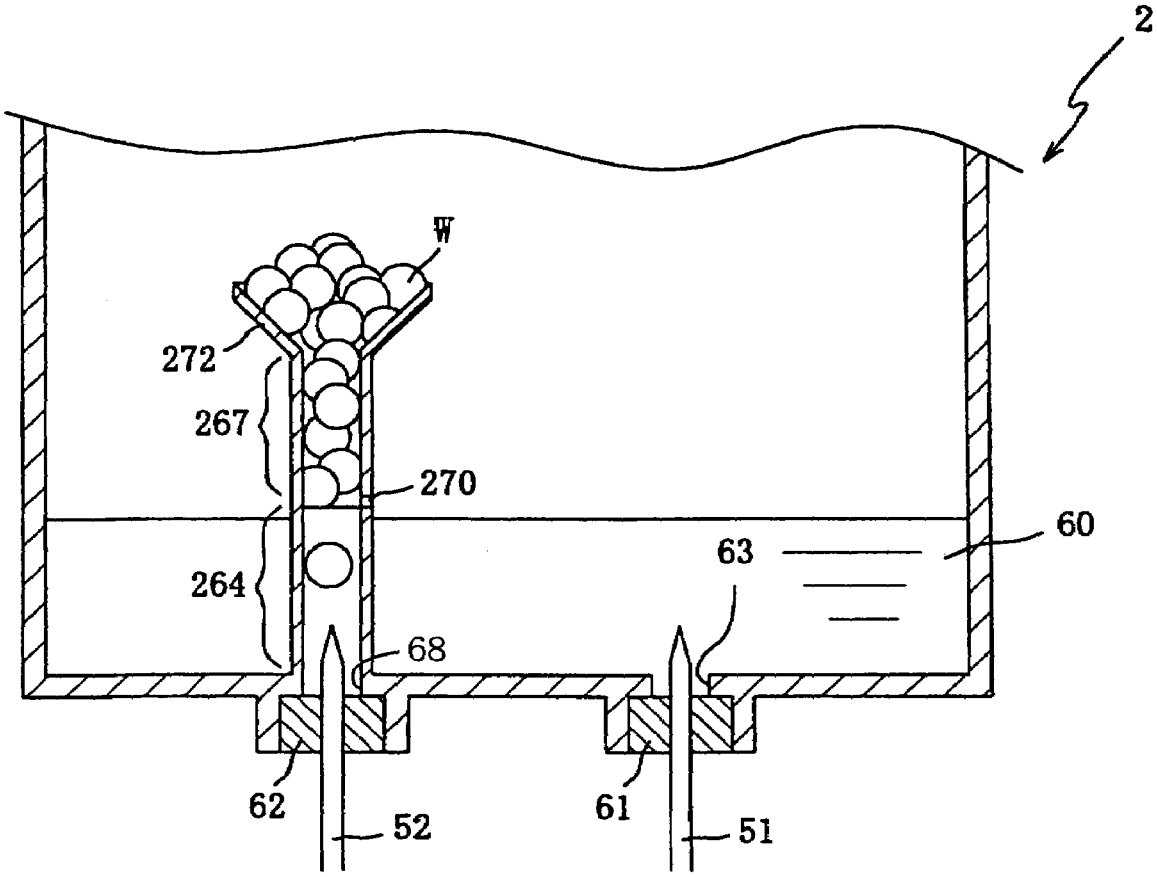
FIG. 6 is a cross sectional view of an ink cartridge which is constructed according to a fourth embodiment.
Figure 7A:
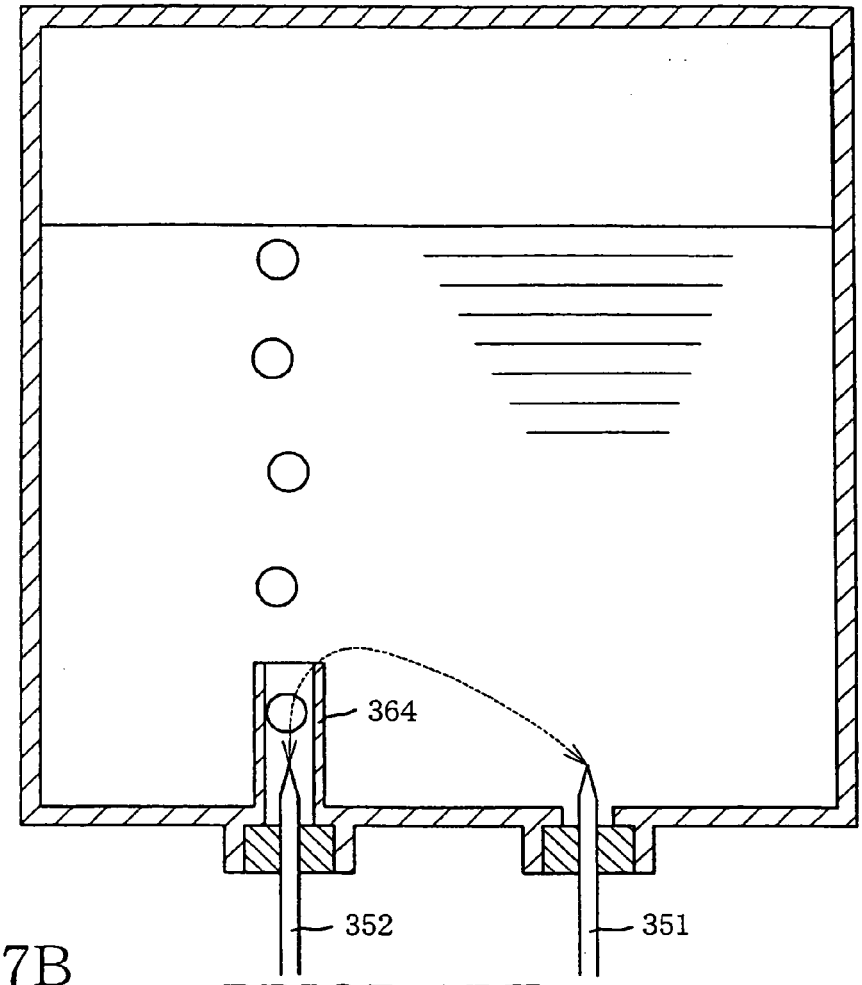
FIG.7A PRIOR ART
FIGS. 7A and 7B are a set of cross sectional views of a conventional ink cartridge, wherein 7A shows a state in which a large amount of ink is left in the ink cartridge, while 7B shows a state in which the ink cartridge should be determined to be near empty.
Figure 7B:
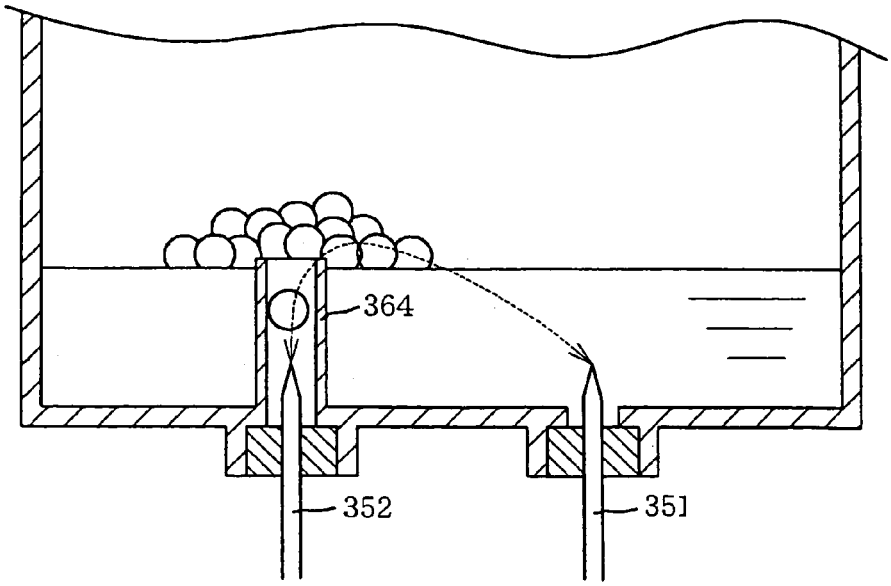
FIG.7B PRIOR ART

Referring next to FIG. 6, there will be described the ink cartridge 2 which is constructed according to a fourth embodiment of the invention. FIG. 6 is a cross sectional view of the ink cartridge 2 installed on the print head 4, showing its near-empty state. The reference numerals as used in the third embodiment will be used to identify the same or similar elements, and redundant description of these elements will not be provided.

The ink cartridge 2 of the present fourth embodiment is different from that of the third embodiment, in that the tubular retainer wall 267 includes a funnel-shaped or tapered upper end portion 272 having an upper open end and a diameter that is increased as viewed in the upward direction.

The tubular retainer wall 267 having the communication hole 270 formed therethrough, so that the space inside the tubular retainer wall 267 is held in communication with the space outside the tubular retainer wall 267 through the communication hole 270. The communication hole 270 has a diameter of about 0.6 mm, like the communication holes 270 in the third embodiment. When the top surface of the ink mass outside the tubular partition wall 264 is higher than the communication hole 270, the ink drawing hollow needle 51 and the air introducing hollow needle 52 are electrically connected via the electrical path A passing through the communication hole 270. When the top surface of the ink mass becomes lower than the communication hole 270, the electrical continuity between the two hollow needles 51, 52 is lost whereby the ink cartridge 2 is determined to be in the near-empty state.

When a large amount of ink 60 is left in the ink cartridge 2, the bubbles W are upwardly moved while being guided by an inner surface of the tubular retainer wall 267. When the ink cartridge 2 is nearly empty, the bubbles W are held inside the tubular retainer wall 267. In this instance, each of the bubbles W is upwardly forced by the succeeding bubble W, and is therefore gradually moved in the upward direction. However, each bubble W is eventually eliminated as the time passes, or is broken as a result of its contact with the inner surface of the tubular wall 267. It is noted that the height of the tubular retainer wall 267 and the size of the funnel-shaped or tapered upper end portion 272 are large enough to prevent the bubbles W from overflowing the upper open end portion 272 even where a large number of bubbles W are generated in case of successive printing operations.

In the ink cartridge 2 constructed as described above, the bubbles W coming out of the air introducing hollow needle 52 can be held by the tubular retainer wall 267 including the funnel-shaped or tapered upper end portion 272 capable of retaining a large number of bubbles W, so that the bubbles W are prevented from coming outside the tubular walls 264, 267 when the top surface of the ink mass outside the tubular walls 264, 267 becomes lower than the communication hole 270. Therefore, even where a large number of bubbles W are generated in case of successive printing operations, an electrical connection between the two hollow needles 51, 52 via the bubbles W is advantageously avoided owing to this arrangement in which the bubbles W are reliably held by the tubular retainer wall 267 including the upper open end portion 272, thereby making it possible to accurately detect the near-empty state of the ink cartridge 2.

Referring next to the schematic view of FIG. 8, there will be described an inkjet recording apparatus in the form of a inkjet printer 401 which is equipped with removably mounted ink cartridges 402 constructed according to a fifth embodiment of this invention. The same reference numerals as used in the first embodiment will be used to identify the same or similar elements.

The inkjet printer 401 includes: the ink cartridges 402 filled with respective color inks; buffer tanks 403 for storing an ink supplied from the ink cartridges 402 through the respective ink drawing hollow needles 451; print heads 405 for ejecting the ink (supplied from the buffer tanks 403 through an ink supply tube 404) toward a paper sheet 6; a carriage 406 for carrying the print heads 405; a pair of guide rods 407 for guiding the carriage 406 which is reciprocated along a straight line; a feeding device 408 for feeding the paper sheet 6 in a predetermined direction; and a purging device 409 having a purge cap 410 and a suction pump (PG pump) 411.

Each ink cartridge 402 includes a casing body 402*a* which defines an inner space for storing the ink and serves as an outer frame of the ink cartridge 402, and a spout 402*b* which is fitted in and fixed to a bottom opening portion of the casing body 402*a* and which has two electrode receivers 421, 422 for receiving the ink drawing hollow needle 451 and air introducing hollow needle 452. These hollow needles 451, 452 define therein passages having respective openings 440, 442 which are located in upper end portions of the hollow needles 451, 452. An inner bottom portion of the casing body 402*a* has slant portions 433, 434 that are inclined downward in the directions from the inner side surfaces of the casing body 402*a* toward the spout 402*b*, whereby ink 60 can be guided toward the spout 402*b*. Thus, the ink 60 reserved in the ink cartridge 402 can be used up, without substantially remaining in the ink cartridge 402.

Plugs 423, 424 are fitted in the respective electrode receivers 421, 422 in a compressed state, for sealing the inner space of the ink cartridge 402. The plugs 423, 424 are in contact with the ink 60 reserved in the ink cartridge 402, through respective openings 425, 426, respectively, which are formed through a bottom of the ink cartridge 402 so as to serve an ink supplying portion and an air introducing portion. The spout 402*b* is formed by integral molding so as to incorporate bubble-movement restrainer walls in the form of first and second tubular barrier walls 464, 466 that surround inner edges of the respective electrode receivers 421, 422, and project into the inner space of the ink cartridge 402. The first and second tubular barrier walls 464, 466 surround the hollow needles 451, 452 in a state that the needles 451, 452 penetrate through the plugs 423, 424, respectively, and extend to a level that is higher than the upper ends of the needles 451, 452. The inside spaces of the first and second tubular barrier walls 464, 466 communicate with the inner space of the ink cartridge 402 via their upper open ends 465, 467, respectively. With the above structure, the hollow needles 451, 452 are in contact with the ink 60 in the ink cartridge 402 via the inside spaces of the tubular barrier walls 464, 466. Further, since the ink drawing hollow needle 451 is surrounded by the first tubular barrier wall 464, the stable supply of the ink 60 through the ink drawing hollow needle 451 is not affected by the bubbles W.

A first communication hole 462 is formed through the first tubular barrier wall 464 at a position close to the bottom portion of the ink cartridge 402 so as to communicate with the inside and the outside of the first tubular barrier wall 464, and a second communication hole 463 is formed through the second tubular barrier wall 466 at a position close to the bottom portion of the ink cartridge 402 so as to communicate with the inside and the outside of the second tubular barrier wall 466. Each of the communication holes 462, 463 has such a cross sectional area or diameter that allows flow or movement of the ink 60 therethrough and inhibits flow or movement of the bubbles W therethrough, so that the bubbles W are held within the second tubular barrier wall 466. Since the first and second communication holes 462, 463 are formed through the lower end portions of the respective first and second tubular barrier walls 464, 466, the electrical continuity between the hollow needles 451 and 452 can maintained until the ink cartridge 402 becomes substantially empty. Further, the ink 60 reserved in the ink cartridge 402 can be used up, without substantially remaining in the ink cartridge 402, thereby leading to an efficient use of the ink 60.

The first communication hole 462 and the second communication hole 463 are formed through the respective tubular barrier walls 464, 466 at positions that do not face each other, preferably at opposite positions such that both of a path connecting the ink drawing hollow needle 451 and the air introducing hollow needle 452 via the first and second communication holes 462, 463 and a path connecting the hollow needles 451 and 452 via the upper open ends 465, 467 of the respective tubular barrier walls 464, 466 are longer than a distance between portions of the hollow needles 451 and 452 which are located within the buffer tank 403. Where the outer circumference of the ink drawing hollow needle 451 is covered by an insulating material over a greater length than the outer circumference of the air introduction hollow needle 452, as shown in FIG. 8, if the communication holes 462, 463 were formed through the respective tubular barrier walls 464, 466 at positions that face each other, the length of the path establishing the continuity between the hollow needles 451 and 452 and passing through the communication holes 462, 463 would be shorter than the length of the path establishing the continuity between the hollow needles 451 and 452 within the buffer tank 403. In this embodiment, however, the electrical path within the ink cartridge 402 is made longer than the electrical path within the buffer tank 403. This arrangement is effective to minimize a possibility that the electrical path within the ink cartridge 402 is formed of the bubbles which remain on the bottom of the ink cartridge 402 after the ink 60 reserved in the ink cartridge 402 has been used up. Further, since the relatively short electrical path in the buffer tank 403 is given a relatively small electrical resistance, an amount of change in the resistance between the hollow needles 451 and 452 can be relatively large when the electrical path in the buffer tank 403 is interrupted, thereby facilitating detection of the interruption of the electrical path in the buffer tank 403.

In the spout 402*b*, the electrode receivers 421 and 422 have the same size, and the first and second tubular barrier walls 464 and 466 have the same size. That is the spout 402*b* is shaped to be symmetrical with respect to a plane which is located at a center between the first and second tubular barrier walls 464 and 466 and which is parallel with axes of the first and second tubular barrier walls 464 and 466. Therefore, the same function can be obtained irrespective of whether the air introducing hollow needle 451 and the air introducing hollow needle 452 are received by the electrode receivers 421 and 422, respectively, or by the electrode receivers 422 and 421, respectively. Therefore, in fixing the spout 402*b* to the casing body 402*a*, it is not necessary to check their relative orientations.

The ink drawing hollow needle 451 and the air introducing hollow needle 452 penetrate through the ceiling of the buffer tank 403 and are fixed to the ceiling so as to be parallel with each other. Made of a conductive material, the hollow needles 451, 452 also serve as electrodes for detection of the remaining amount of the ink 60. The hollow needles 451 and 452 are electrically insulated from each other by the plugs 423, 424 and the spout 402*b*. Upper end portions of the hollow needles 451, 452 project from the upper surface of the buffer tank 403 and stick in the ink cartridge 402, while lower end portions of the hollow needles 451, 452 are located inside the buffer tank 403. A lower end of the ink drawing hollow needle 451 having a relatively large length is positioned to be lower than a lower end of the air introducing hollow needle 452 having a relatively small length, so that the lower end of the ink drawing hollow needle 451 can be immersed in the ink mass in the buffer tank 403 while the lower end of the air introducing hollow needle 452 can be in contact with a portion of the ink mass which is located near its top surface.

When the ink cartridge 402 is attached to the buffer tank 403, the tips of the respective hollow needles 451, 452 are pierced through the respective plugs 423, 424 so as to come into contact with the ink 60 reserved in the inner space of the ink cartridge 402. Made of an elastic material such as butyl rubber, the plugs 423, 424 allows the hollow needles 451, 452 to be pierced therethrough. Further, since as described above the plugs 423, 424 are fitted in the electrode receivers 421, 422 in a compressed state, the plugs 423, 424 are restored to a sealing state even after the needles 451 and 452 are pulled out.

The buffer tank 403 is provided, at its upper portion, with an air connection passage 431 having an upper open end, so that the inner space of the buffer tank 403 is held in communication with the atmosphere via the air connection passage 431.

Figure 8:
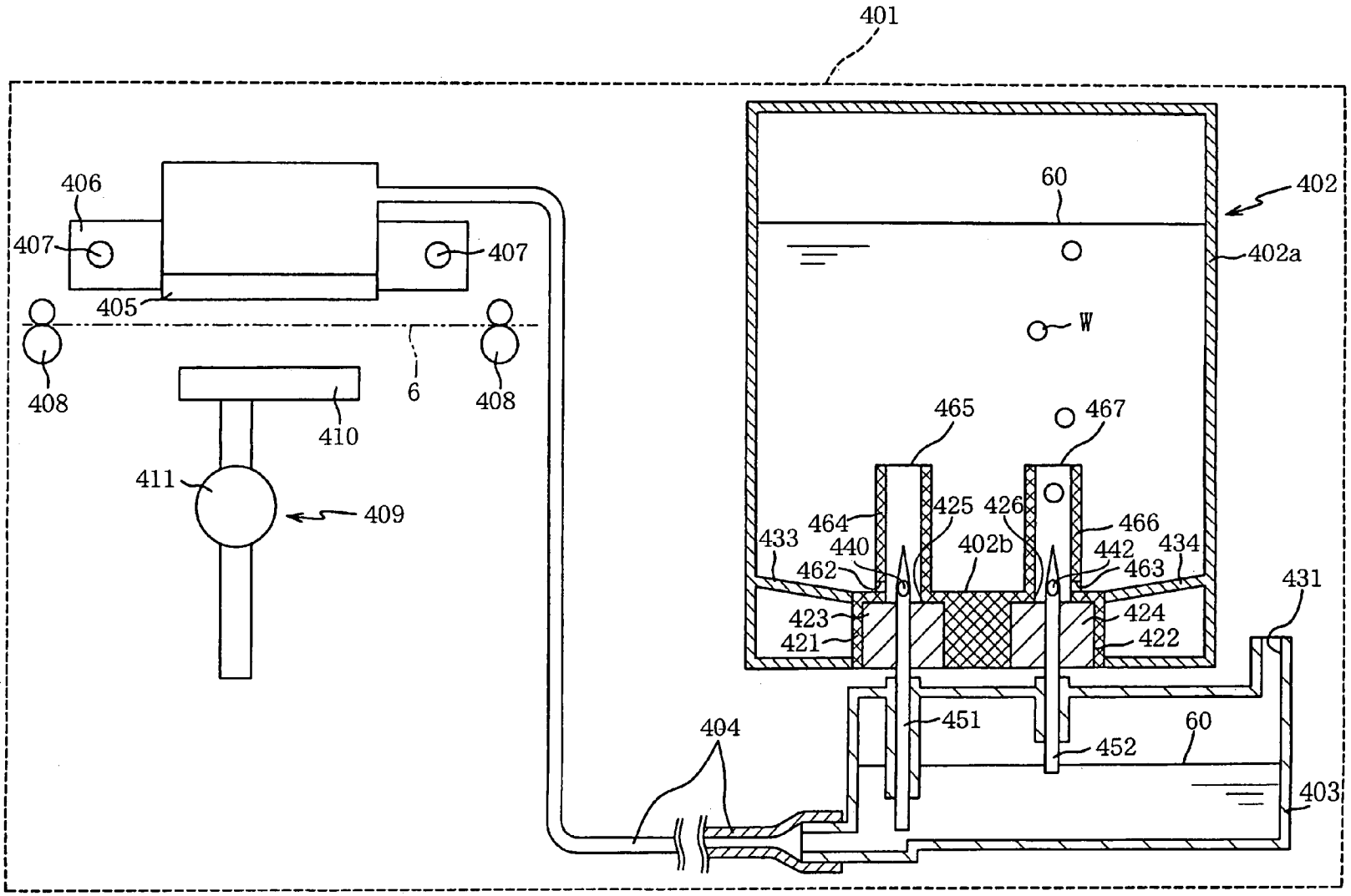
FIG. 8 is a view schematically showing an inkjet recording apparatus equipped with an ink cartridge which is constructed according to a fifth embodiment of the invention.

When the ink 60 is ejected from the print head 405 toward the paper sheet 6 after the ink cartridge 402 was attached to the buffer tank 403 as shown in FIG. 8, the ink 60 of the same amount as the ejected ink 60 is supplied from the buffer tank 403 toward the print head 405 via the ink supply tube 404. As the ink 60 is thus supplied, the top surface of the ink mass in the buffer tank 403 is lowered whereby the lower open end of the air introducing hollow needle 452 is exposed to the inner space in the buffer tank 403. As a result, the air is introduced into the ink cartridge 402 via the air connection passage 431, the inner space in the buffer tank 403 and the air introducing hollow needle 452.

When the air is introduced into the ink cartridge 402, the ink 60 is drawn from the ink cartridge 402 into the buffer tank 403 via the ink drawing hollow needle 451, whereby the top surface of the ink mass in the buffer tank 403 is newly elevated so that the lower open end of the air introducing hollow needle 452 is immersed in the ink 60. In this manner, the top surface of the ink mass in the buffer tank 403 is kept substantially in a level corresponding to the height of the lower open end of the air introducing hollow needle 452. In the steady state, both of the ink drawing hollow needle 451 and the air introducing hollow needle 452 are in contact with the ink 60.

Then, when all the ink 60 in the ink cartridge 2 has been used up, the top surface of the ink mass in the buffer tank 403 is lowered as the ink 60 in the buffer tank 403 is consumed, whereby the air introducing hollow needle 452 is rendered in a state that it is not in contact with the ink 60.

Figure 9:
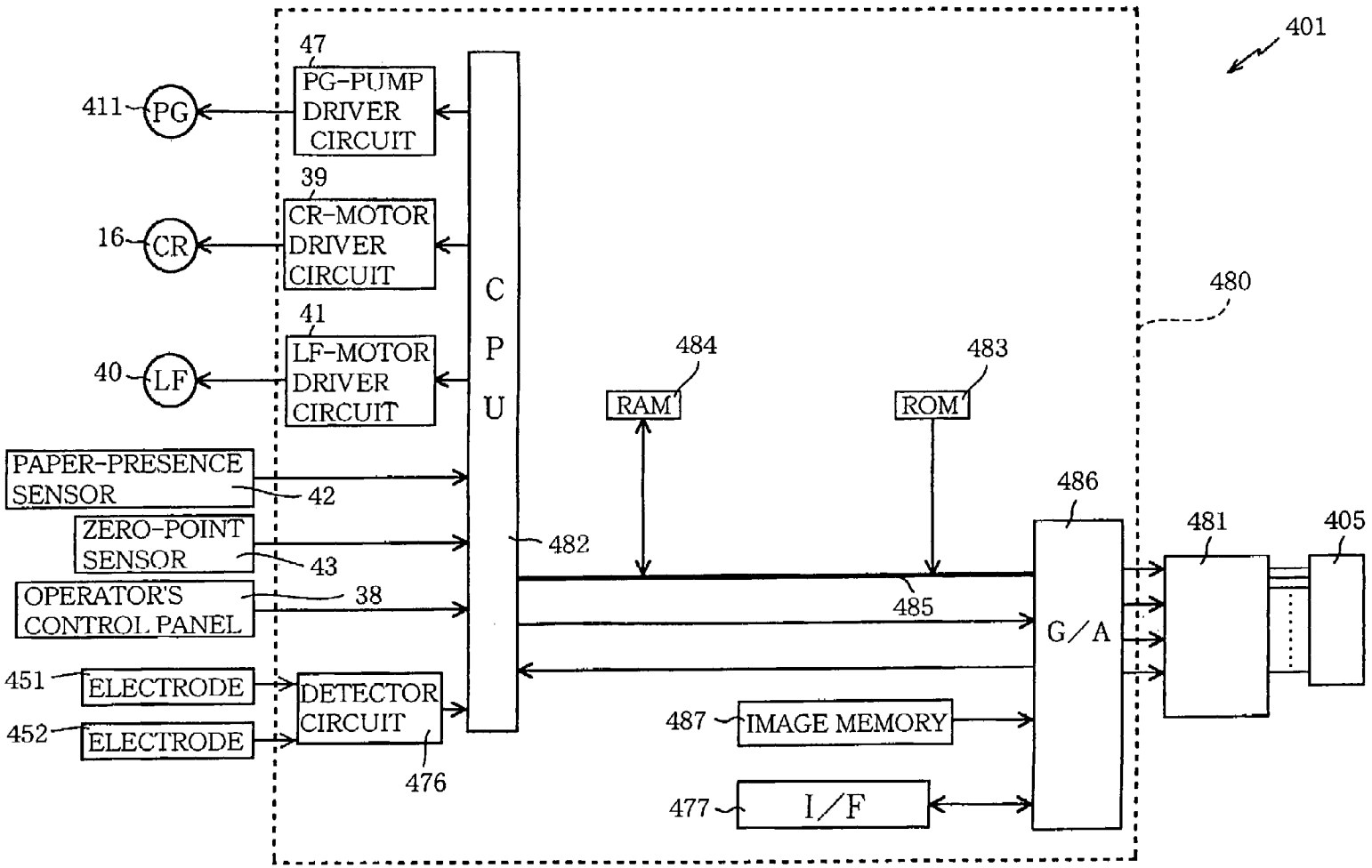
FIG. 9 is a block diagram illustrating an electric circuit arrangement of the inkjet recording apparatus of FIG. 8.

As shown in FIG. 9, the inkjet printer 401 is provided with a control device including a main control board 480 mounted on a main body of the inkjet printer 401, and a carriage board 481 mounted on the carriage 406. The main control board 480 incorporates: a CPU (one-chip microcomputer) 482; a ROM 483 storing various control programs executed by the CPU 482 and various fixed data used by the CPU 482; a RAM 484 for temporarily storing various data; an image memory 487; and a G/A (gate array) 486 operable to store, in the image memory 487, the image data received from an external computer or other device through an I/F (centro-interface) 477. The CPU 482, ROM 484, RAM 484 and G/A 486 are connected to each other through a bus line 485. The CPU 482 has substantially the same function as the above-described CPU 32 in the first embodiment. To the CPU 482, there are connected the same or similar elements as those connected to the CPU 32 in the first embodiment, such as a detector circuit 476 for detecting a resistance between the ink drawing hollow needle 451 and the air introducing hollow needle 452 which serve as the first and second electrodes, respectively.

The detector circuit 476 is provided to apply a voltage between the ink drawing hollow needle 451 and the air introducing hollow needle 452, and to detect a resistance between the two hollow needles 451, 452. The detector circuit 476 transfers data indicative of the detected resistance, to the CPU 482, so that the CPU 482 detects the amount of the ink remaining in the buffer tank 403 and the amount of the ink remaining in the ink cartridge 402, on the basis of the transferred data.

More specifically, in a steady state (see FIG. 8), the electrical path between the two hollow needles 451 and 452 is formed of the ink 60, so that a relatively small resistance value (e.g., about 10 to about 20 kΩ) is detected between the two hollow needles 451 and 452. However, in a state in which the top surface of the ink mass has been lowered by consume of the ink 60 so as to be lower than the lower end portion of the air introducing hollow needle 452, the electrical path is lost whereby a relatively large resistance value (e.g., about 10 to about 20 MΩ) is detected between the two hollow needles 451 and 452. The increase in the resistance value makes the CPU 62 determine that the buffer tank 403 is in the near-empty state.

Next, there will be described change in the amount of the ink 60 remaining in the ink cartridge 402, with reference to FIGS. 10A–10C which are a set of cross sectional views of the ink carriage 402 and the buffer tank 403. It is noted that the print head 405 and the ink supply tube 406 are not illustrated in FIGS. 10A–10C.

In a state that a large amount of ink 60 remains in the ink cartridge 402, as shown in FIG. 8, the bubbles W generated as a result of introduction of the air into the ink 60 through the air introducing hollow needle 452 move upwardly, passing through the second tubular barrier wall 466 which surrounds the air introducing hollow needle 452.

Figure 10A:
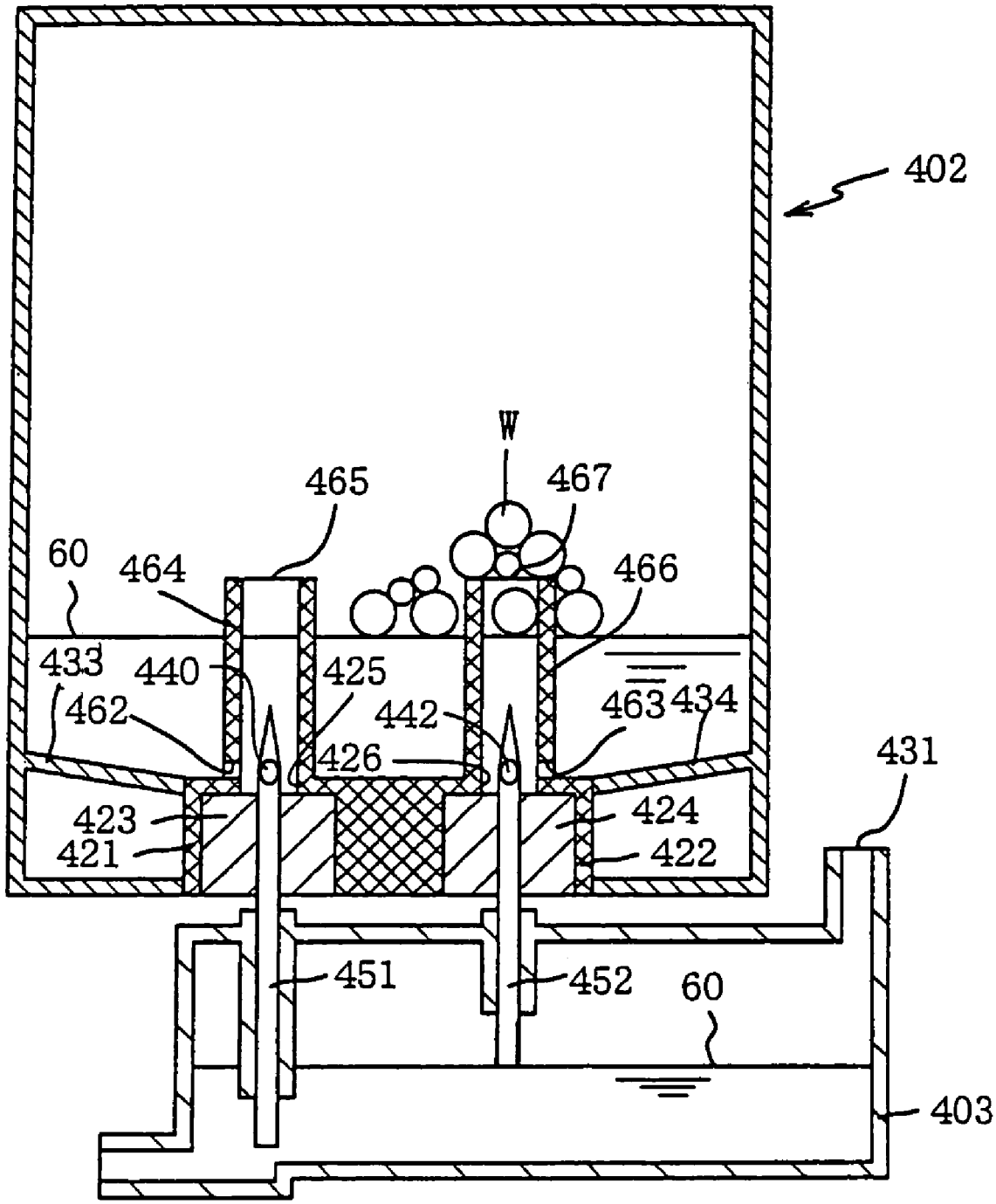
FIGS. 10A–10C are a set of cross sectional views of the ink carriage and the buffer tank of FIG. 8, wherein 10A shows a state in which a top surface of ink mass in the ink cartridge has become lower than upper ends of first and second tubular barrier walls, 10B shows a state immediately after the ink cartridge has become substantially empty, and 10C shows a state in which a printing operation by the inkjet recording apparatus is stopped.

Then, when the ink 60 in the ink cartridge 402 has been consumed and the top surface of the ink mass in the ink cartridge 402 has become lower than the upper ends of the first and second tubular barrier walls 464, 466, as shown in FIG. 10A, the bubbles W remain on the top surface of the ink mass inside and around the second tubular barrier wall 466. In this state shown in FIG. 10A, the air introducing hollow needle 452 is in contact at its lower end with the top surface of the ink mass in the buffer tank 403.

Figure 10B:
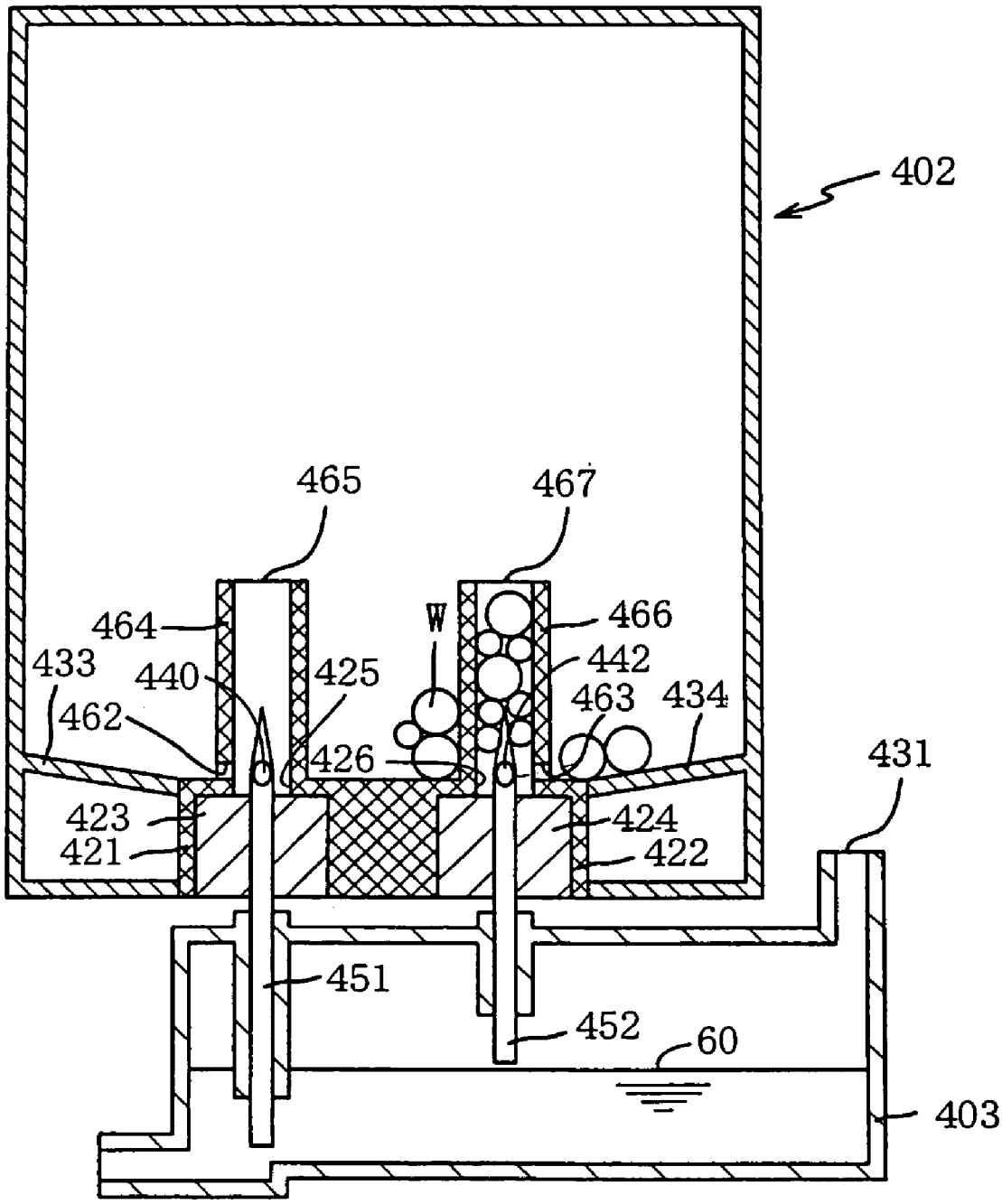
Figure 10C:
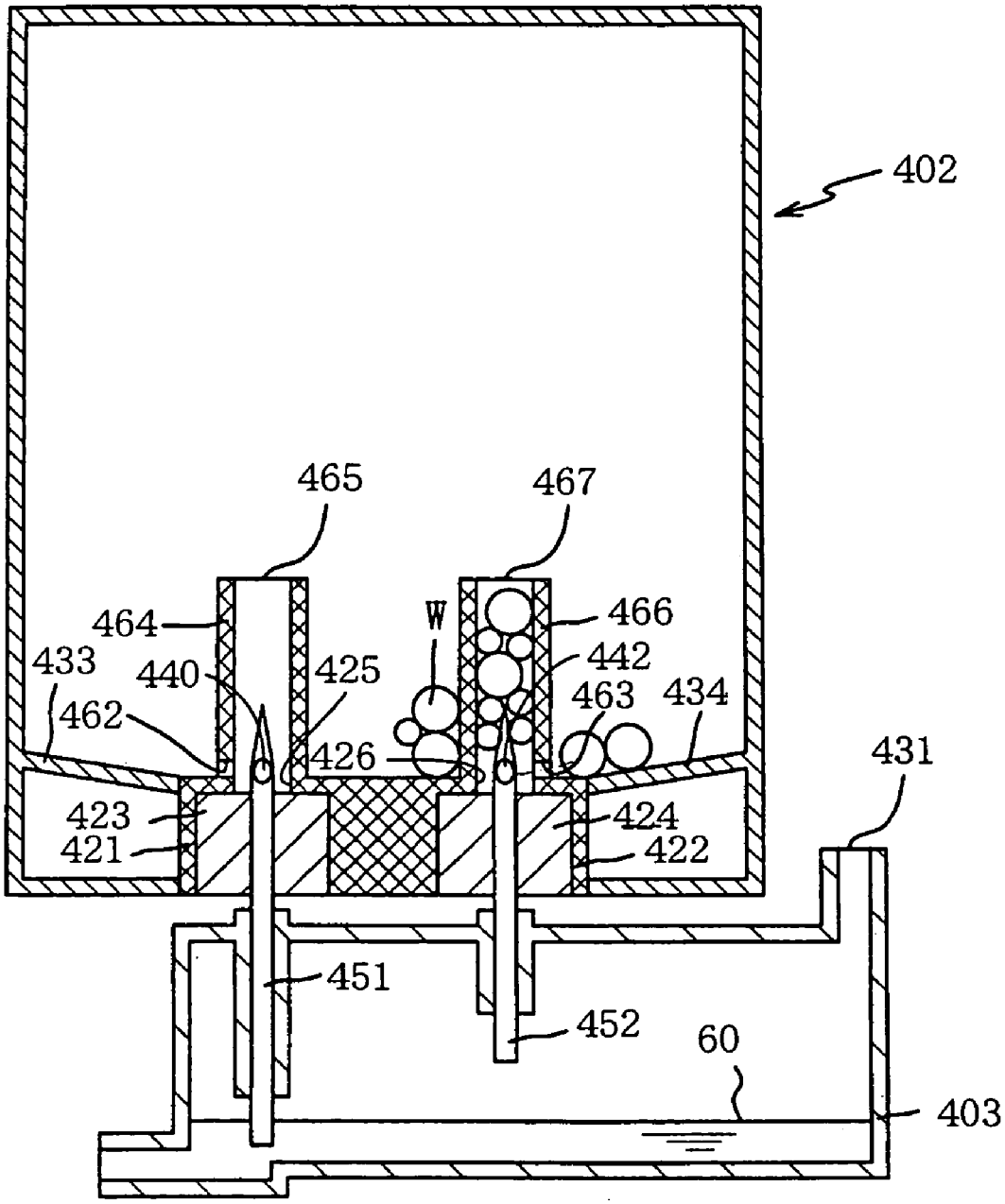

When the ink 60 in the ink cartridge 402 has been further consumed so as to be substantially used up, as shown in FIG. 10B, only the bubbles W remain in the ink cartridge 402. Since the second communication hole 463 is formed through the second tubular barrier wall 466 at the position close to the bottom portion of the ink cartridge 402, the ink 60 flows out of the second tubular barrier wall 466 while most of the bubbles W are held within the second tubular barrier wall 466. In this state immediately after the ink cartridge 402 has become substantially empty, the top surface of the ink mass in the buffer tank 403 is slightly separated from the lower end of the air introducing hollow needle 452. The electrical continuity between the hollow needles 451 and 452 is thus lost, so that the resistance between the hollow needles 451 and 452 is increased to about 10 to about 20 MΩ, whereby it is determined that the ink cartridge 402 is empty or that the buffer tank 403 is near empty. In this instance, even if some of the bubbles W are located outside the second tubular barrier wall 466, these bubbles W are reliably prevented by the first tubular barrier wall 464 surrounding the ink drawing hollow needle 451, from being brought into contact with the hollow needles 451. That is, the ink drawing hollow needle 451 and the air introducing hollow needle 452 are prevented from being electrically connected to each other through the bubbles W.

When it is determined that the ink cartridge 402 has become empty, namely, when it is determined that the ink remaining amount has become small, a message indicative of this fact is displayed on, for example, the operator's control panel 38. The printing operation may be still continued for a while, rather than being stopped immediately upon the determination of the near-empty state. That is, the printing operation may be continued until it is determined that a predetermined amount of ink 60 has been further used after the determination of the empty state of the ink cartridge 402. This determination as to whether the predetermined amount of ink 60 has been further used can be made by counting a sum of an ink amount ejected from the nozzles of the print head 405 and an ink amount removed from the print head 405 by the purging device 409, for example, in accordance with a control program stored in the ROM 483. FIG. 10C shows a state in which the printing operation is eventually stopped after the predetermined amount of ink 60 has been further used.

When a transition is made from the state that a large amount of ink 60 remains (as shown in FIG. 8) to the state that the top surface of the ink mass is lower than the upper ends of the first and second tubular barrier walls 464, 466 (as shown in FIG. 10A), the bubbles W staying on the top surface of the ink mass might enter the inside of the first tubular barrier wall 464. However, the electrical continuity is not established between the two hollow needles 451 and 452 via those bubbles W, because the inner diameter of the first tubular barrier wall 464 is much smaller than the entire area of the top surface of the ink mass, and the bubbles W are likely to disappear or to be dissolved in the ink 60 before the top surface of the ink mass becomes lower than the upper ends of the first and second tubular barrier walls 464, 466.

As described above, in the ink cartridge 402 according to the fifth embodiment of the invention, the electrical continuity between the hollow needles 451 and 452 is restrained or prevented by the first and second tubular barrier walls 464, 466, from being established by the bubbles W generated in the ink cartridge 402. Therefore, after the ink 60 reserved in the ink cartridge 402 has been used up, an electrical path allowing the continuity between the two hollow needles 451 and 452 is not formed in the inner space of the ink cartridge 402, thereby making it possible to accurately detect the empty state of the ink cartridge 402.

Figure 11:
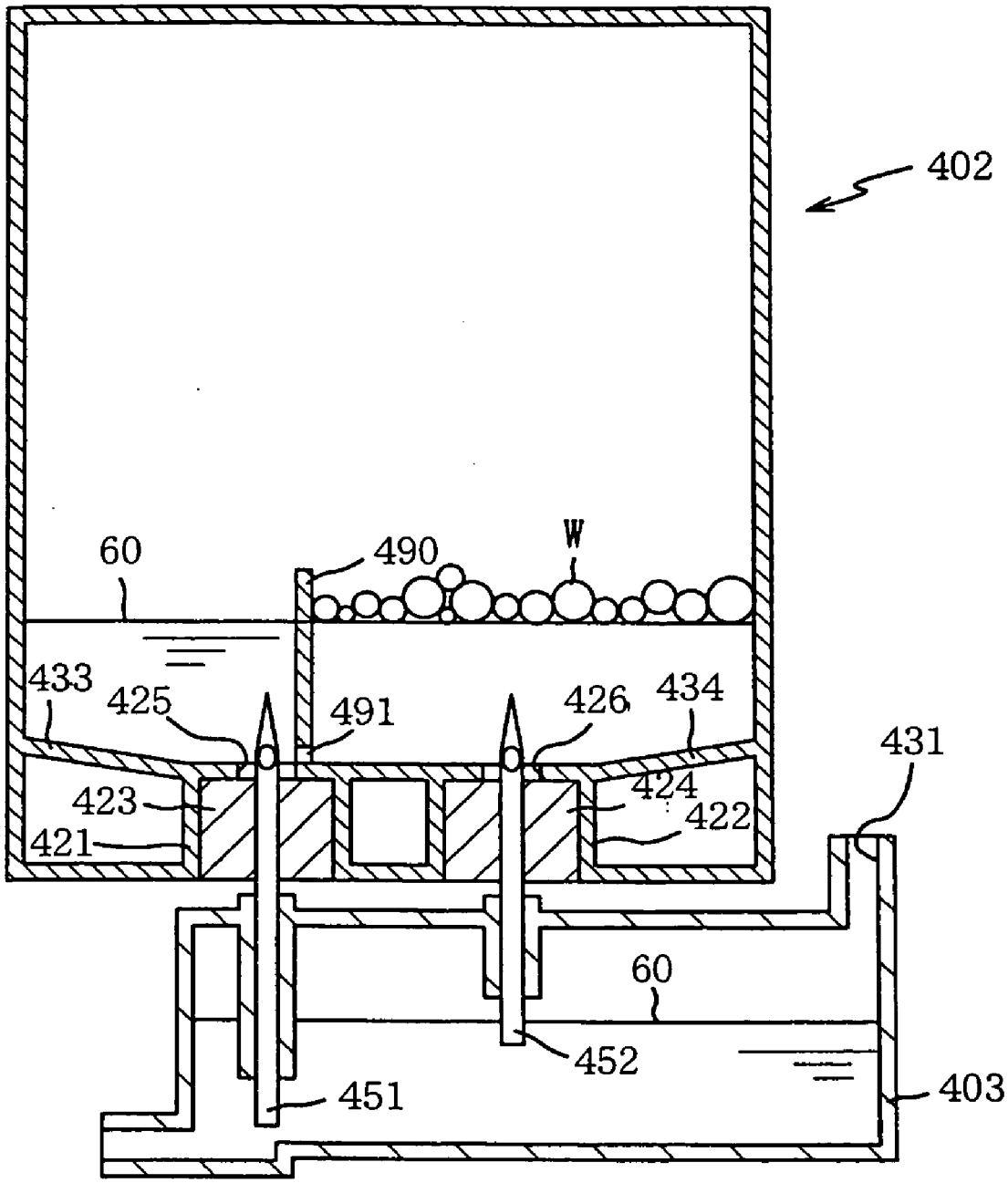
FIG. 11 is a cross sectional view of an ink cartridge which is constructed according to a sixth embodiment.
Figure 12:
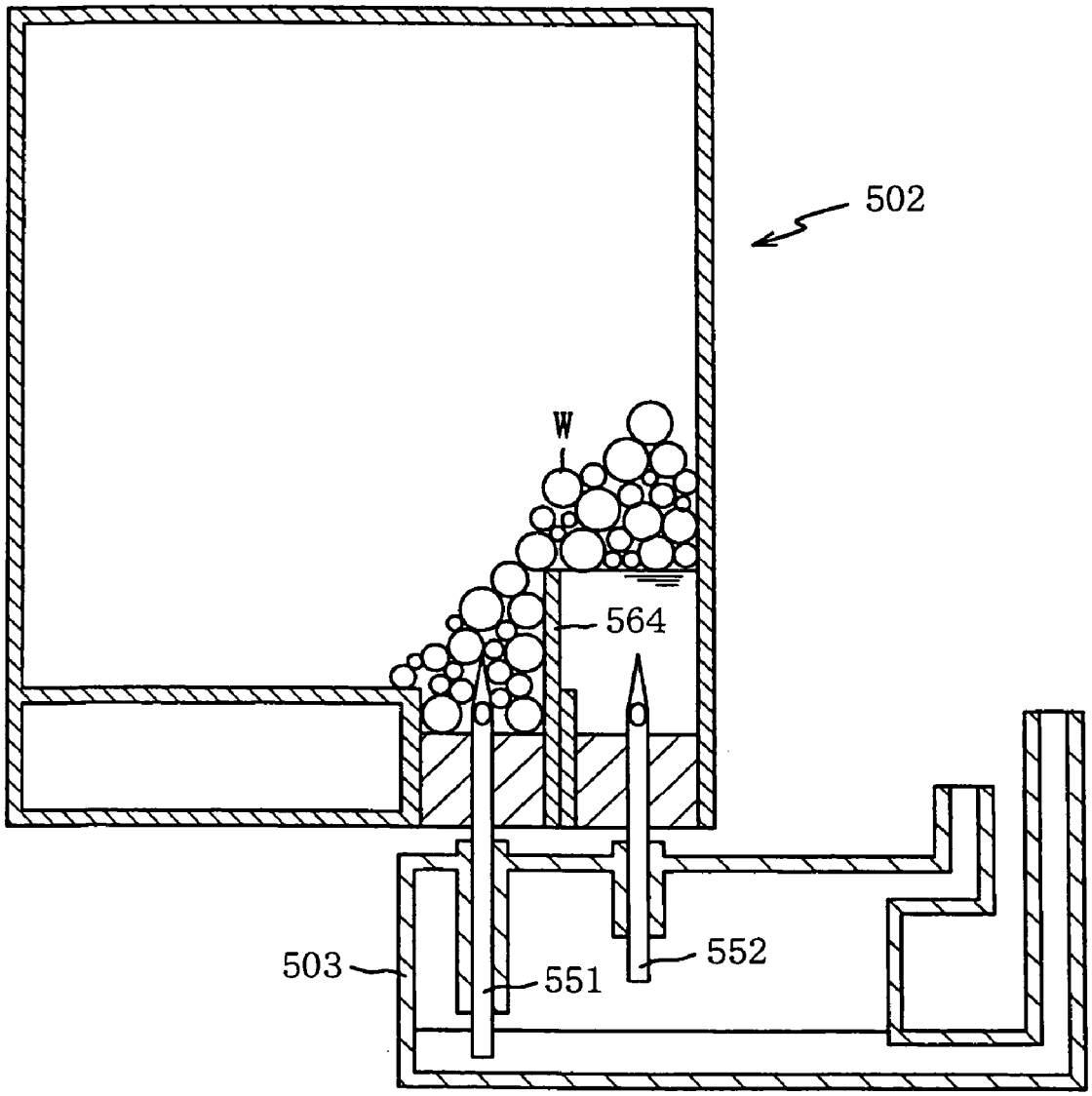
FIG.12 PRIOR ART
FIG. 12 is a cross sectional view of a conventional ink cartridge.

Referring next to FIG. 11, there will be described the ink cartridge 402 according to a sixth embodiment of the invention. The ink cartridge 402 of this sixth embodiment is substantially identical with that of the above-described fifth embodiment, except that the two tubular barrier walls 451, 452 are replaced by a flat barrier wall 490. The same reference numerals as used in the fifth embodiment will be used to identify the same or similar elements, and redundant description of these elements will not be provided.

The flat barrier wall 490 is disposed between the ink drawing hollow needle 451 and the air intruding hollow needle 452, and projects upwardly from the bottom of the ink cartridge 402. The flat barrier wall 490 divides a lower portion of the inner space of the ink cartridge 402 into a first region and a second region into which the ink drawing hollow needle 451 and the air intruding hollow needle 452 are introduced. A communication hole 491 is formed through the flat barrier wall 490 at a position that is close to the bottom of the ink cartridge 402. The communication hole 491 has such a cross sectional area or diameter that allows movement of the ink 60 therethrough and inhibits movement of the bubbles W therethrough. Since the communication hole 491 is formed through the lower end portion of the flat barrier wall 490, the electrical continuity between the hollow needles 451 and 452 can be maintained until the ink cartridge 402 becomes substantially empty, and the ink 60 reserved in the ink cartridge 402 can be used up, without substantially remaining in the ink cartridge 402.

The flat barrier wall 490 is positioned to be closer to the ink drawing hollow needle 451 than to the air introducing hollow needle 452, and to be closer to the side surface of the ink cartridge 402 that defines the first region than to the side surface of the ink cartridge 402 that defines the second region. Therefore, the second region is given a horizontal cross sectional area larger than that of the first region.

As shown in FIG. 11, in a state that the top surface of the ink mass in the ink cartridge 402 has become lower than the upper end of the flat barrier wall 490 as a result of consume of the ink 60, the bubbles W are restrained or prevented by the flat barrier wall 490, from flowing from the second region to the first region. The bubbles W generated in the second region are kept there and dissolved in the ink 60 as the time passes. In this instance, since the second region in which the bubbles W are held has the relatively large horizontal cross sectional area, the bubbles W are not likely to be piled on each other before their eliminations, thereby minimizing a possibility that the bubbles W passes over the upper end of the flat barrier wall 490. Therefore, even where a large number of bubbles W are generated in case of successive printing operations, an electrical connection between the two hollow needles 451, 452 via the bubbles W is advantageously avoided, thereby making it possible to accurately detect the empty state of the ink cartridge 402.

In the above-described first through sixth embodiments, the first and second electrodes are provided by the ink drawing hollow needle 51 or 451 and the air introducing hollow needle 52 or 452, the number of components and the manufacturing cost for the apparatus can be made smaller and lower than in an arrangement in which the electrodes are provided by members serving exclusively as the electrodes.

While preferred embodiments of this invention have been described above, it is to be understood that the invention is not limited to the details of the illustrated embodiments, but may be embodied with various changes and modifications, which may occur to those skilled in the art, without departing from the sprit and scope of the present invention.

For example, in the first embodiment, the single bubble breaker 65 as the bubble-path-formation restrainer is provided in the ink cartridge 2. However, a plurality of bubble breakers may be provided such that the sharp-pointed distal end portion of each of the bubble breakers is positioned right above the upper open end 66 of the tubular partition wall 64.

Further, in the first embodiment, the upper end portion of the tubular partition wall 64 may be tapered or otherwise shaped such that the diameter of the upper end portion of the tubular partition wall 64 is decreased as viewed in the upward direction. In this modified arrangement, the upper open end 66 has a diameter which is made smaller than the inside diameter of the tubular partition wall 64, so that each bubble W can be more reliably guided toward the sharp-pointed distal end portion 67 of the bubble breaker 65, so as to be more reliably broken by the bubble breaker 65.

Figure 13:
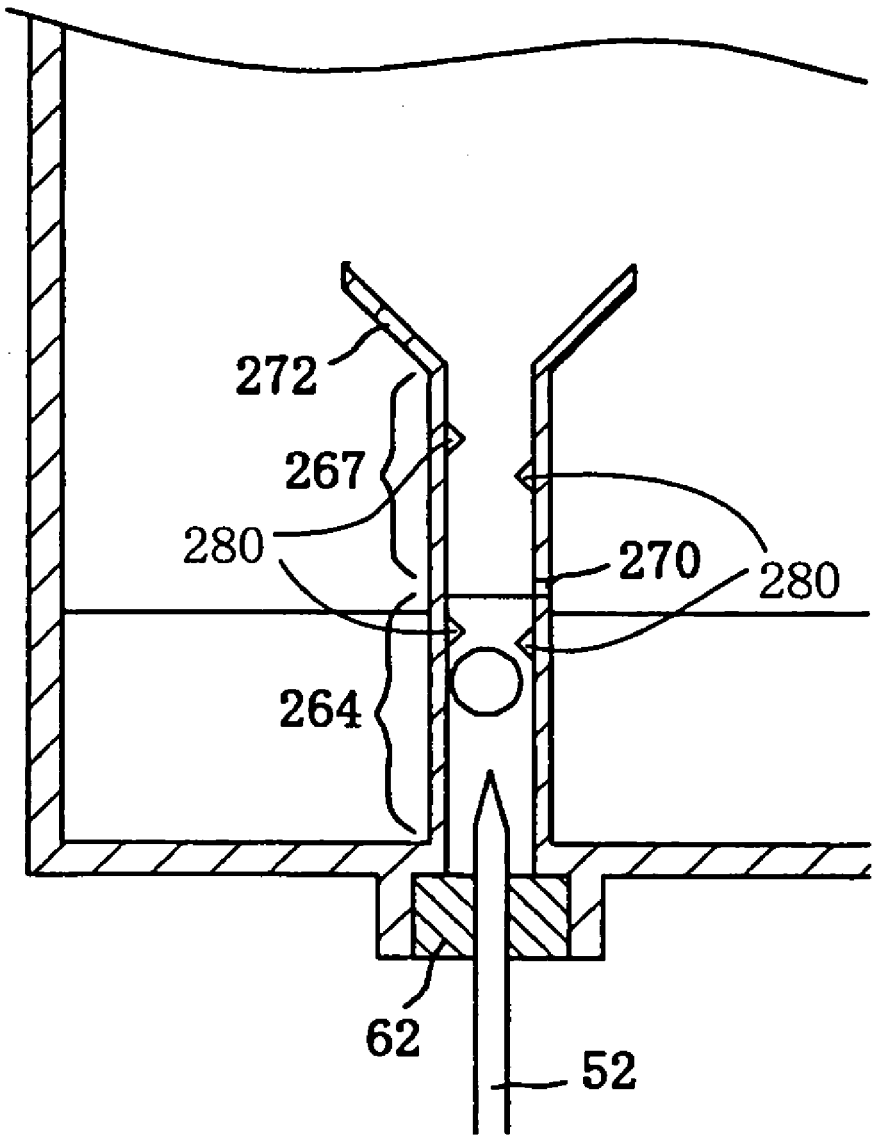
FIG. 13 is a cross sectional view of a part of an ink cartridge which is constructed according to a modification of the fourth embodiment.

Further, in the first through fifth embodiments, each of the tubular barrier walls 64, 264, 466 and the tubular retainer walls 167, 267 may have a protrusion or protrusions 280 formed on its inner surface, as shown in FIG. 13, so that the bubbles W coming out of the air introducing hollow needle 52 and upwardly moving are brought into contact with the protrusion 280, so as to be more reliably eliminated.

The arrangements of the first through fourth embodiments may be incorporated into or combined with each other, as needed. For example, each of the tubular retainer walls 167, 267 in the second embodiment may include the funnel-shaped or tapered upper end portion 272, as in the fourth embodiment. Further, the number of the communication hole or holes 270 may be increase or reduced.

While each of the partition walls 64, 164, 264, the retainer walls 167, 267 and the restrainer walls 464, 466 in the first through fifth embodiments is provided by a tubular wall, it may be provided also by a wall which connects mutually horizontally opposed portions of an inner circumferential surface of the ink cartridge 2 or 402 such that the wall is interposed between the ink drawing hollow needle 51 or 451 and the air introducing hollow needle 52 or 452.

In the illustrated embodiments, the ink drawing hollow needle 51 or 451 and the air introducing hollow needle 52 or 452 are introduced into the inner space of the ink cartridge 2 or 402, with the ink cartridge 2 or 402 being installed on the print head 4 or 405. Namely, the hollow needles are not parts of the ink cartridge in the illustrated embodiments. However, the ink cartridge may be constructed to include the hollow needles as its own parts, so that the hollow needles of the ink cartridge are received by the mount portion 3 or the buffer tank 403 when the ink cartridge is installed on the print head 4 or 405.

In the fifth embodiment, the first and second tubular barrier walls 464, 466 are provided in the ink cartridge 402. However, the provision of the second tubular barrier wall 466 is not essential, since the ink drawing hollow needle 451 and the air introducing hollow needle 452 can be prevented from being electrically connected to each other via the bubbles W, only by the first tubular barrier wall 464 which prevents the ink drawing hollow needle 451 from being brought into contact with the bubbles W. Further, the second tubular wall 466 may be shaped to extend up to an upper portion of the inner space of the ink cartridge 402.

In the fifth and sixth embodiments, the casing body 402*a* is formed with the slant portions 33, 34. However, the ink cartridge 402 may be constructed such that the entirety of the bottom portion is constituted by the spout 402*b* which includes the slant portions. In this case, the shape of the casing body 402*a* can be simplified whereby the ink cartridge 402 can be manufactured with higher efficiency.

In the sixth embodiment, the barrier wall 490 projects from the bottom of the ink cartridge 402 in a direction perpendicular to the bottom of the cartridge 402. However, the barrier wall 490 may projects in a direction inclined with respect to the perpendicular direction, or may includes a bent portion, such that a distance between the barrier wall 490 and the ink drawing hollow needle 451 is decreased as viewed in the upward direction.

Figure 14:
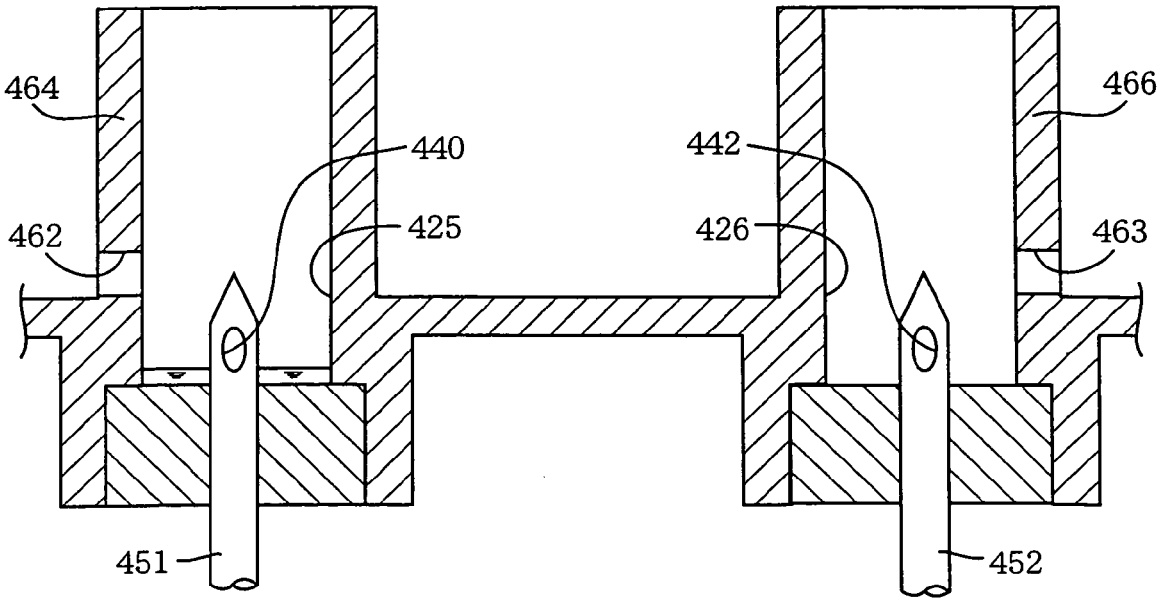
FIG. 14 is a cross sectional view of a part of an ink cartridge which is constructed according to a modification of the fifth embodiment.

In the fifth and sixth embodiments, the ink 60 is discharged from the ink cartridge 402 to the buffer tank 403 through the ink drawing hollow needle 451, more specifically described, through a passage which is defined in the hollow needle 451 and which opens in the opening 440 located in the upper end portion of the hollow needle 451. In this construction, even after all the ink 60 reserved in the ink cartridge 402 has been substantially used up, a small amount of ink 60 might remain in an annular space (see FIG. 14) which is located below the opening 440 and which has a lower end defined by the plug 423 and/or in an annular space which is located below the opening 442 and which has a lower end defined by the plug 424. In view of this, it is preferable that the openings 440, 442 of the hollow needles 451, 452 are positioned to be lower than positions of the communication holes 462, 463 which are formed through the tubular barrier walls 464, 466, so that the small amount of ink remaining in the annular spaces are distant from the communication holes 462, 463, as shown in FIG. 14, for further reliably restraining the electrical path from being formed of the bubbles W.

What is claimed is:

1. An ink cartridge for reserving an ink in an inner space defined therein, comprising:

an ink supplying portion provided to face a lower portion of said inner space so as to allow supply of the ink from said inner space therethrough;

an air introducing portion provided to face said lower portion of said inner space so as to allow introduction of an air into said inner space therethrough;

a partition which projects upwardly from a bottom of the ink cartridge so as to have a predetermined height, and which divides said lower portion of said inner space into a first region and a second region;

at least one electrode receiver for receiving a first electrode and a second electrode, such that said first electrode faces said first region while said second electrode faces said second region; and a bubble-path-formation restrainer restraining an electrical path allowing an electrical continuity between said first electrode and said second electrode, from being formed of a bubble which is generated as a result of the introduction of the air into said inner space, wherein said bubble-path-formation restrainer includes a bubble breaker which breaks the bubble.

2. The ink cartridge according to claim 1, wherein said electrical path is formed of the ink when a top surface of the ink reserved in said inner space is higher than an upper end of said partition, and said electrical path is interrupted by said partition when the top surface of the ink is lower than said upper end of said partition.

3. The ink cartridge according to claim 1, wherein said bubble breaker has a sharp-pointed distal end portion which is positioned right above said air introducing portion.

4. The ink cartridge according to claim 1, wherein said first electrode is provided by a hollow member which defines therein an ink supplying passage communicating with said ink supplying portion, and wherein said ink supplying portion is provided by said at least one electrode receiver.

5. The ink cartridge according to claim 1, wherein said second electrode is provided by a hollow member which defines therein an air introducing passage communicating with said air introducing portion, and wherein said air introducing portion is provided by said at least one electrode receiver.

6. The ink cartridge according to claim 5, wherein said partition is a tubular partition wall surrounding said hollow member.

7. The ink cartridge according to claim 6, wherein said tubular partition wall has a plurality of protrusions formed on an inner surface thereof, and wherein said bubble breaker is provided by said plurality of protrusions.

8. The ink cartridge according to claim 1, wherein said bubble-path-formation restrainer includes a bubble retainer which retains the bubble on one of opposite sides of said partition so as to restrain the bubble from being moved from said first region to said second region.

9. The ink cartridge according to claim 8, wherein said bubble retainer retains the bubble in a position higher than said predetermined height of said partition.

10. The ink cartridge according to claim 9, wherein said bubble retainer includes a retainer wall which is connected to an upper end of said partition and projects upwardly from said upper end of said partition, wherein said retainer wall has a through-hole which is formed through a lower end portion of said retainer wall, and which has such a size that allows movement of the ink therethrough and inhibits movement of the bubble therethrough, and wherein said bubble breaker is provided by an edge of said through-hole.

11. The ink cartridge according to claim 10, wherein said retainer wall and said partition are formed integrally with each other.

12. The ink cartridge according to claim 8, wherein said bubble retainer includes a tubular retainer wall vertically extending and having an upper open end which is higher than said predetermined height, and wherein said tubular retainer wall is positioned relative to said air introducing portion such that said tubular retainer wall surrounds a portion of said inner space which portion is located right above said air introducing portion.

13. The ink cartridge according to claim 12, wherein said tubular retainer wall has a plurality of through-holes formed therethrough and each having such a size that allows movement of the ink therethrough and inhibits movement of the bubble therethrough, and wherein said bubble breaker is provided by an edge of each of said through-holes.

14. The ink cartridge according to claim 12, wherein said tubular retainer wall includes an upper end portion having a diameter which is increased as viewed in an upward direction.

15. The ink cartridge according to claim 12, wherein said tubular retainer wall has a plurality of protrusions formed on an inner surface thereof, and wherein said bubble breaker is provided by an edge of each of said through-holes.

16. The ink cartridge according to claim 1, wherein said bubble-path-formation restrainer includes a bubble-movement restrainer wall which is disposed between said first electrode and said second electrode, and which projects upwardly from an upper end of said partition, said bubble-movement restrainer wall restraining movement of the bubble between opposite sides thereof while allowing movement of the ink between opposite sides thereof.

17. The ink cartridge according to claim 1, wherein each of at least one of said ink supplying portion and said air introducing portion is to introduce a hollow member into said lower portion of said inner space therethrough.

18. An inkjet recording apparatus comprising:

the ink cartridge defined in claim 1;

a recording portion which receives the ink supplied from said inner space of said ink cartridge through said ink supplying portion, so as to record an image on a recording medium; and a detector which detects an electrical characteristic between said first electrode and said second electrode.

19. The inkjet recording apparatus according to claim 18; wherein said detector detects that an electrical resistance between said first electrode and said second electrode is larger than a predetermined value.

20. An ink cartridge for reserving an ink in an inner space defined therein, comprising:

an ink supplying portion provided to face a lower portion of said inner space so as to allow supply of the ink from said inner space therethrough;

an air introducing portion provided to face said lower portion of said inner space so as to allow introduction of an air into said inner space therethrough;

at least one electrode receiver for receiving a first electrode and a second electrode, such that said first electrode and said second electrode faces said inner space; and a bubble-path-formation restrainer restraining an electrical path allowing an electrical continuity between said first electrode and said second electrode, from being formed of a bubble which is generated as a result of the introduction of the air into said inner space, wherein said bubble-path-formation restrainer includes a bubble-movement restrainer wall which is disposed between said first electrode and said second electrode, and which restrains movement of the bubble between opposite sides thereof while allowing movement of the ink between opposite sides thereof.

21. The ink cartridge according to claim 20, further comprising:

a partition which projects upwardly from a bottom of the ink cartridge so as to have a predetermined height, and which divides a lower portion of said inner space into a first region and a second, which said first electrode and said second electrode face, respectively, wherein said bubble-movement restrainer wall of said bubble-path-formation restrainer is connected to an upper end of said partition and projects upwardly from said upper end of said partition.

22. The ink cartridge according to claim 21, wherein said bubble-movement restrainer wall and said partition are formed integrally with each other.

23. The ink cartridge according to claim 21, wherein said electrical path is formed of the ink when a top surface of the ink reserved in said inner space is higher than an upper end of said partition, and said electrical path is interrupted by said partition when the top surface of the ink is lower than said upper end of said partition.

24. The ink cartridge according to claim 21, wherein said air introducing portion is to introduce a hollow member, which defines therein an air introducing passage, into said lower portion of said inner space therethrough, wherein said partition is a tubular partition wall that is located to surround said hollow member, and wherein said bubble-movement restrainer wall is a tubular retainer wall that is connected to said tubular partition wall.

25. The ink cartridge according to claim 24, wherein said second electrode is provided by said hollow member, and wherein said air introducing portion is provided by said at least one electrode receiver.

26. The ink cartridge according to claim 24, wherein said tubular retainer wall includes an upper end portion having a diameter which is increased as viewed in an upward direction.

27. The ink cartridge according to claim 24, wherein said tubular retainer wall has a plurality of protrusions formed on an inner surface thereof.

28. The ink cartridge according to claim 24, wherein said tubular partition wall has a plurality of protrusions formed on an inner surface thereof.

29. The ink cartridge according to claim 20, wherein said bubble-movement restrainer wall divides said lower portion of said inner space into a first region and a second region which has a horizontal cross section area lager than that of said first region, and wherein said air introducing portion is provided to face said second region.

30. The ink cartridge according to claim 29, wherein said bubble-movement restrainer wall has a through-hole which is formed through a lower end portion thereof, and which has a size that allows movement of the ink therethrough and inhibits movement of the bubbles therethrough.

31. The ink cartridge according to claim 20, wherein said bubble-movement restrainer wall has a through-hole which is formed through a lower end portion thereof, and which has such a size that allows movement of the ink therethrough and inhibits movement of the bubble therethrough.

32. The ink cartridge according to claim 20, wherein said bubble-movement restrainer wall includes a tubular barrier wall surrounding said ink supplying portion.

33. The ink cartridge according to claim 32, wherein said tubular barrier wall has a through-hole which is formed through a lower end portion thereof, and which has such a size that allows movement of the ink therethrough and inhibits movement of the bubble therethrough.

34. The ink cartridge according to claim 32, wherein said bubble-movement restrainer wall includes, in addition of said tubular barrier wall as a first tubular barrier wall, a second tubular barrier wall surrounding said air introducing portion, and wherein said second tubular barrier wall has a through-hole which is formed through a lower end portion thereof, and which has such a size that allows movement of the ink therethrough and inhibits movement of the bubble therethrough.

35. An inkjet recording apparatus comprising:

the ink cartridge defined in claim 20;

a recording portion which receives the ink supplied from said inner space of said ink cartridge through said ink supplying portion, so as to record an image on a recording medium; and a detector which detects an electrical characteristic between said first electrode and said second electrode.

36. An inkjet recording apparatus comprising:

the ink cartridge defined in claim 20;

a recording portion which records an image on a recording medium with the ink;

a buffer tank which supplies the ink supplied from said inner space of said ink cartridge through said ink supplying portion, to said recording portion, said buffer tank defining an inner space which is held in communication with an atmosphere;

a first hollow member which extends from a lower portion of said inner space of said buffer tank to said lower portion of said inner space of said ink cartridge so as to supply the ink to said buffer tank from said ink cartridge, said first hollow member providing said first electrode;

a second hollow member which extends from an upper portion of said inner space of said buffer tank to said lower portion of said inner space of said ink cartridge so as to introduce the air into said ink cartridge from said buffer tank, said second hollow member providing said second electrode;

a detector which detects an electrical characteristic between said first electrode and said second electrode; and a determiner which determines, on the basis of detection by said detector, whether an amount of the ink remaining in said buffer tank is lower than a predetermined amount or not.

37. The inkjet recording apparatus according to claim 36, wherein said bubble-movement restrainer wall includes a first tubular barrier wall surrounding said first hollow member, and a second tubular barrier wall surrounding said second hollow member, wherein said first tubular barrier wall has a first through-hole which is formed through a lower end portion thereof, and which has such a size that allows movement of the ink therethrough and inhibits movement of the bubble therethrough, wherein said second tubular barrier wall has a second through-hole which is formed through a lower end portion thereof, and which has such a size that allows movement of the ink therethrough and inhibits movement of the bubble therethrough, and wherein said first through-hole and said second through-hole are positioned relative to each other such that a path connecting said first and second hollow members and passing through said first and second through-holes is longer than a distance between portions of said first and second hollow members which are located in said inner space of said buffer tank.

38. The inkjet recording apparatus according to claim 36, wherein said detector detects that an electrical resistance between said first electrode and said second electrode is larger than a predetermined value.

39. The ink cartridge according to claim 20, further comprising:

a partition which projects upwardly from a bottom of the ink cartridge so as to have a predetermined height, and which divides a lower portion of said inner space into a first region and a second region which said first electrode and said second electrode face, respectively, wherein said air introducing portion is to introduce a hollow member, which defines therein an air introducing passage, into said lower portion of said inner space therethrough, wherein said bubble-movement restrainer wall of said bubble-path-formation restrainer projects upwardly from said bottom of the ink cartridge, and has an upper end which is higher than said predetermined height, wherein said bubble-movement restrainer wall is disposed between said hollow member and said partition, and said partition is disposed between said first electrode and said second electrode, and wherein said bubble-movement restrainer wall has an aperture formed through a portion thereof which is lower than said predetermined height and which is to be lower than an upper opening end portion of said hollow member defining therein said air introducing passage.

40. The ink cartridge according to claim 39, wherein said partition is a tubular partition wall that is located to surround said hollow member defining therein said air introducing passage, and wherein said bubble-movement restrainer wall is a tubular retainer wall that is located inside said tubular partition wall, so as to surround said hollow member.

41. The ink cartridge according to claim 20, wherein said first electrode is provided by a hollow member which defines therein an ink supplying passage communicating with said ink supplying portion, and wherein said ink supplying portion is provided by said at least one electrode receiver.

42. The ink cartridge according to claim 20, wherein said second electrode is provided by a hollow member which defines therein an air introducing passage communicating with said air introducing portion, and wherein said air introducing portion is provided by said at least one electrode receiver.

* * * * *